US011472513B2

(12) United States Patent
Bonomi

(10) Patent No.: US 11,472,513 B2
(45) Date of Patent: Oct. 18, 2022

(54) NAUTICAL CLEAT INSTALLABLE ON A BOAT AND BOAT COMPRISING SAID NAUTICAL CLEAT

(71) Applicant: Cristiano Bonomi, Milan (IT)

(72) Inventor: Cristiano Bonomi, Milan (IT)

(73) Assignee: Cristiano Bonomi, Milan (IT)

( * ) Notice: Subject to any disclaimer, the term of this patent is extended or adjusted under 35 U.S.C. 154(b) by 99 days.

(21) Appl. No.: 17/091,544

(22) Filed: Nov. 6, 2020

(65) Prior Publication Data

US 2022/0212759 A1 Jul. 7, 2022

Related U.S. Application Data

(60) Provisional application No. 62/985,563, filed on Mar. 5, 2020.

(51) Int. Cl.
*B63B 21/04* (2006.01)
*B63B 21/16* (2006.01)

(52) U.S. Cl.
CPC ..... *B63B 21/045* (2013.01); *B63B 21/16* (2013.01)

(58) Field of Classification Search
CPC ..... B63B 21/04; B63B 21/045; B63B 21/08; B63B 21/16
USPC ..... 114/218, 381, 230.1, 230.2, 230.23, 114/230.25, 230.26
See application file for complete search history.

(56) References Cited

U.S. PATENT DOCUMENTS 3,851,613 A * 12/1974 Armour ..... B63B 21/08 242/380
7,841,287 B2 * 11/2010 Wingate ..... B63B 21/04 114/230.2

FOREIGN PATENT DOCUMENTS

IT 2017 0011 7788 * 4/2019 ..... B63B 21/04

* cited by examiner

*Primary Examiner* — Daniel V Venne
(74) *Attorney, Agent, or Firm* — Patterson Intellectual Property Law, P.C.

(57) ABSTRACT

A nautical cleat is provided for tying a rope of a boat. First and second shafts are installable on a deck via first and second positioning elements, respectively, and further support first and second tying elements, respectively. A transverse body mechanically connects said first and second tying elements. Fastening means securely fasten said first and second positioning elements to said deck. A first roller-shaped towing element tows and rolls up said rope and is rotatable about a first rotation axis defined by said first shaft. A second roller-shaped towing element is rotatable about a second rotation axis defined by said second shaft and substantially parallel to said first rotation axis. An actuating device comprises at least one motor operatively connected to said first and/or second roller-shaped towing element. Connecting means connect the actuating device to said deck, wherein said actuating device is placed in a position underlying said lower surface. A spherical joint, operatively interposed between the first shaft and the transverse body, allows the rotation of the transverse body with respect to said first shaft, around at least one substantially horizontal axis.

25 Claims, 15 Drawing Sheets

NAUTICAL CLEAT INSTALLABLE ON A BOAT AND BOAT COMPRISING SAID NAUTICAL CLEAT

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of U.S. Provisional Patent Application No. 62/985,563 filed Mar. 5, 2020, and which is hereby incorporated by reference in its entirety.

FIELD OF THE INVENTION

The present invention relates to the field of vessel mooring devices. In particular, the present invention concerns a nautical cleat, which can be installed on a deck of a boat allowing an easy towing and retrieving of the mooring rope, thus highly decreasing the physical effort normally required from the crew. Also, the present invention relates to a boat provided with such a cleat.

BACKGROUND

Mooring devices, or mooring units, installed on boats are normally used to allow boats mooring at quays. Among these there is a device known as "nautical cleat". Typically, a nautical cleat is defined by a metal or wood structure, fixed on a deck of a boat by bolting, at which a mooring rope is tied. The latter is aimed at enabling the mooring operation and at securing the boat. Often, in a boat four cleats are provided, one at each edge of the boat, i.e. two cleats at stern and two at the bow. Overall, the four cleats settle four contact and tension points for the boat, in order to keep it stuck in a prefixed position.

The present disclosure specifically refers to the field of nautical cleats which aim is that of providing a structure having two opposing ends configured for tying a rope by performing a knot which develops around each of said two opposing ends. Obviously, a bollard does not provide for this possibility.

Usually, a cleat (504) comprises one or more plates (501), fixed to the deck (500), from which two short rods (502) develop. Such rods (502) support two ends (503), which depart towards two opposite directions and which aim at tiding a rope (600) (see FIGS. 1 and 2). In particular, the rope (600) is fixed by making a knot, known as "cleat knot", which may be carried out in different ways, according to the necessity or unnecessity of quickly untying the knot itself. Examples of two different modes are shown in FIG. 2. Usually the two ends are joined by a bar (505), but there are also cleats without such a bar (505).

Although the confusion which may be made on this regard, it is known for the seamen that the nautical cleats are structurally and functionally very different from the bollards. Actually, the nautical term "bollard" refers to a device as the one shown in FIG. 3, that is to say a device (700) comprising a short and sturdy column (701) normally installed on a harbour quay and sometimes on a vessel deck. Typically, a mooring cable (703) is tied or wrapped around said column (701). The bollard comprises an enlarged portion (702) at the end of the column (701), which may be in the form of a mushroom or a collar, aimed at avoiding the rope or the bowline or other mooring cable (703) to slip off the when it is tensioned.

For this reason, the cleat shown in FIG. 1 as to be considered as the closest prior art, while the bollard of FIG. 3 is a structurally and operatively different device, completely unrelated to the context of the present invention.

Mooring a boat always requires a great physical effort from the sailor in charge. The end of the mooring rope is anchored to a fixed point on a quay or on a dead weight located at the bottom of the sea. In other words, a quay may define a fixed point on heart while a dead weight defines a fixed point in the sea.

In order to perform the mooring operation, the sailor in charge wraps the rope around one of the two short rods of the cleat and manually tows the same, usually standing on the opposite side of the cleat with respect to the side where the rope is tensioned (anchored to the quay or to the dead weight). By means of the manual towing action, the boat is drawn at the quay or at a different mooring location. When the desired position has been reached, the sailor performs a mooring knot, in order to keep the boat in such a position.

While performing the knot, the tension of the rope is progressively and unavoidably lost. For this reason, the sailor has to tie the rope as fast as can, in order to avoid losing the desired position and/or to avoid losing too much tension. Thereby follows that the sailor in charge for the boat mooring has to be provided with great strength and high experience in order to be able to perform the operation in a safe and fast way.

As it is easy to understand, the bigger and heavier the boat is, more the mooring operation becomes difficult.

In order to decrease the effort required from the sailors it is known to use winches placed on the deck of the boat at a position which is more or less close to the cleat. These devices are used to temporary tow the rope which must be thereafter tied to the cleat.

However, this solution results to be barely effective and above all it is unpopular among seamen since it encumbers the boat, thereby reducing the small room available on the deck.

Moreover, once the desired position and tension have been reached, the sailor has to release the rope from the winch in order to rapidly fixt it to the cleat achieving thereby the mooring position. Therefore, although using a winch, the strength, ability, and experience of the sailor are main factor for the success of the maneuver.

The above-mentioned difficulties and drawbacks existing for the mooring operations, occur also for the kedging operations, which must be performed after a certain period of time from the mooring. As a matter of fact, the fabric ropes used for mooring are subjected to elongation due to high wind or high undertow stress conditions. The kedging operation aims to bring the desired stress of the mooring rope back and, in case, to restore or modify the mooring position.

To perform the kedging operation, it is necessary to untie the mooring knot, tension the rope and make a new mooning knot. It is clear that also this operation requires high ability and high expertise.

A further inconvenience of the known cleats, as the one illustrated in FIG. 1, is related to the fact that, since the decks of boats presents not linear but curved surfaces, when the rope is tensioned, a stress zone is created in the bar (505) joining the two opposing ends (503). As a matter of fact, the two rods (502) are parallel to each other and rigidly connected one to the other by the bar (505) which is perpendicular to them. This stress may cause the breaking of the cleat (504) and/or damages to the deck (500).

BRIEF SUMMARY

In view of the above considerations, the main task of the present disclosure is that of providing a nautical cleat able to overtake the above-mentioned drawbacks. In particular, a first object of the present disclosure is to provide a nautical cleat which achieves a reduction of the physical efforts required from the crew. A further object of the present disclosure is to make available a nautical cleat able to ease both the mooring and the kedging operations. Another object of the present disclosure is that of providing a nautical cleat easy to be installed on a boat deck. A further object of the present disclosure is to provide a mooring unit which is reliable and easy to manufacture at competitive costs. Also, the present disclosure is aimed at providing a cleat which overcomes the above-mentioned breaking off problem.

These and other objects are achieved by means of a nautical cleat as disclosed herein. In a particular embodiment, the above objects are achieved by means of a cleat installable on a deck which comprises a deck upper surface and a deck lower surface. The cleat comprises:

a first shaft installable on said deck by means of a first positioning element, said first shaft supporting a first tying element;

a second shaft installable on said deck by means of a second positioning element, said second shaft supporting a second tying element;

a transverse body mechanically connecting said first tying element to said second tying element;

fastening means to securely fasten said first positioning element and said second positioning element to said deck.

The cleat according to an embodiment as disclosed herein comprises:

a first roller-shaped towing element to tow and roll up said rope, wherein said towing element is rotatable about a first rotation axis defined by said first shaft;

a second roller-shaped towing element rotatable about a second rotation axis defined by said second shaft, said second rotation axis being substantially parallel to said first rotation axis;

an actuating device comprising at least one motor operatively connected to said first roller-shaped towing element and/or to said second roller-shaped towing element;

connecting means designed for directly or indirectly connecting the actuating device to said deck, so that said actuating device is placed in a position underlying said lower surface;

a spherical joint, operatively interposed between the first shaft and the transverse body, designed to allow the rotation of the transverse body with respect to said first shaft about at least one substantially horizontal axis.

A cleat with the above features achieves all the above-mentioned objects. As a matter of fact, it highly reduces the physical effort required from the crew in both the mooring and kedging operations thanks to the fact that the towing element, or the towing elements, is/are motorized by means of the actuation device. Therefore, the towing action and the rope retrieving operation is carried out by the sailor without any physical effort, even in case of huge and heavy vessels. Moreover, when the rope has been retrieved, the sailor is able to perform the cleat knot using the two knotting elements, without the necessity of clearing the rope from the towing element.

Furthermore, such a cleat is reliable and easy to be installed and manufactured at competitive costs. Finally, the as claimed cleat, being provided with a spherical joint operatively interposed between the first shaft and the transverse body, allows the rotation of the transverse body with respect to the first shaft, thereby allowing adjustment between the two shafts and compensating the curve surface of the deck. In this way, the stress problem is overtaken and the cleat is not subjected to breaking off.

In a preferred embodiment as disclosed herein, said towing element has a concave roller configuration defined by a first part and a second part substantially symmetrical with respect to a plane substantially orthogonal to said first axis. Each of said parts comprises a gripping surface tapered in the direction of said first axis so as to define, when the two parts are joined together, a concave portion of said towing element. This concave portion is configured to clamp the mooring rope in a vice due to the rotation of the towing element and to the partial wrapping of the same rope around the same towing element. After the clamping, the mooring rope is tensioned between the anchoring fixed point (for example a quay) and the towing element. When the motor is switched off, the towing element is stuck in position by the same motor and the rope is tensioned upstream the towing element, in order to keep the desired position of the boat. The portion of the rope downstream the towing element, i.e. the portion coming out from the towing element, is not tensioned and may be easily handled by the sailor, who may easily perform a knot without any rush. Therefore, thanks to the cleat as disclosed herein, also a sailor without strength, ability and experience may safely perform a cleat knot.

Preferably said spherical joint comprises an outer joint portion, designed to be fixed to the transverse element, and an inner joint portion, placed inside the outer joint portion and designed to be fixed to the first shaft. This configuration of the joint results easy and effective.

According to preferred embodiments as disclosed herein, the first positioning element is installable in proximity to a deck through opening defined through said deck, and said connecting means comprise connecting screws suitable for passing through said opening, in order to connect said actuating device to said first positioning element. In this way, the actuating device is supported by the first positioning element. The pass-through opening defined through the deck, allows the connection between the actuating device and the towing element. At the same time, it is used to connect the actuating device (beneath the deck) with the emerging portion of the cleat (above the deck). This solution is very economical in terms of installation time and costs.

Preferably, the first shaft and/or the second shaft is/are operatively connected to the motor by means of a mechanical transmission.

The first rotation axis of said first towing element may be substantially orthogonal or substantially parallel to the rotation axis of the motor.

The first positioning elements and the second positioning element may be made in a single body or in two independent bodies.

According to preferred embodiments as disclosed herein, the first positioning element comprises a flange portion and a centering body insertable in the deck opening and the connecting means comprise a connecting body, integral with the actuating device, and a plurality of connecting screws susceptible to crossing corresponding cavities defined through the centering body to be screwed on said connecting body.

Preferably, the nautical cleat comprises a diverter element designed for preventing rope from entirely rolling up around said first towing element. This diverter element may comprise an arm at least partially protruding into said concave portion of the first towing element or a concave portion designed to house the rope.

Moreover, said diverter element may be fixed to said flange portion of said first positioning element or to deck or to said transverse element.

Preferably the first part and the second part of the first towing element are placed at a variable distance one from the other, in order to house ropes with different diameters therethrough and more preferably, a spring located upwardly or downwardly said first towing element, allows reciprocal approaching and departing of said first part and second part from each other.

According to a possible embodiment, the first shaft is rotatable about said first rotation axis together with said first towing element and the second shaft is rotatable about said second rotation axis together with said second towing element, the first shaft and the second shaft are operatively connected to said motor by means of a mechanical transmission.

According to some embodiments, the actuating device comprises two motors, a first one operatively connected to said first roller-shaped towing element and a second one operatively connected to said second roller-shaped towing element. According to a particular embodiment, the nautical cleat comprises:

a first shaft installable on said deck by means of a first positioning element, said first shaft supporting a first tying element;

a second shaft installable on said deck by means of a second positioning element, said second shaft supporting a second tying element;

a transverse body mechanically connecting said first tying element to said second tying element;

fastening means to securely fasten said first positioning element and said second positioning element to said deck, first roller-shaped towing element to tow and roll up said rope, wherein said towing element is rotatable about a first rotation axis defined by said first shaft;

a second roller-shaped towing element rotatable about a second rotation axis defined by said second shaft, said second rotation axis being substantially parallel to said first rotation axis;

an actuating device comprising two motors a first one operatively connected to said first roller-shaped towing element and a second one operatively connected to said second roller-shaped towing element;

connecting means designed for directly or indirectly connecting the actuating device to said deck, so that said actuating device is placed in a position underlying said lower surface;

a spherical joint, operatively interposed between one of said shafts and the transverse body, designed to allow the rotation of the transverse body with respect to said one of said shafts, around at least one substantially horizontal axis.

The two motors may be actuated by a single actuation button.

Advantageously, the first towing element and the second towing element are vertically offset in order to avoid the rope portion outgoing from the cleat from obstructing the rope portion entering therein.

Advantageously, the two towing elements have the same configuration, wherein at least one of said towing elements, preferably both, has a concave roller configuration defined by a first part and by a second part substantially symmetrical with respect to a plane substantially orthogonal to said first axis, each of said parts comprising a gripping surface tapered in the direction of the corresponding axis so as to define, when the two parts are joined together, a concave portion of said towing element.

Even when the cleat is provided with two motors, the spherical joint may comprise an outer joint portion, designed to be fixed to the transverse element, and an inner joint portion, placed inside the outer joint portion and designed to be fixed to the corresponding shaft.

Even when the cleat is provided with two motors, the first positioning element and the second positioning element are installable in proximity to corresponding pass-through openings defined through said deck, and wherein said connecting means comprise connecting screws suitable for passing through said opening in order to connect said actuating device to said first positioning element and to said second positioning element.

Even when the cleat is provided with two motors, the first rotation axis of the first towing element and the second rotation axis of the second towing element may be substantially orthogonal or parallel to the rotation axis of the motors.

Even when the cleat is provided with two motors, the first positioning elements and the second positioning means may be made in a single body.

Further, even when the cleat is provided with two motors, the first positioning element may comprise a flange portion and a centring body insertable in said deck opening and wherein said connecting means may comprise a connecting body, integral with said actuating device, and a plurality of connecting screws susceptible to pass through corresponding cavities defined through said centring body to be screwed on said connecting body and wherein said second positioning element may have the same conformation of the first positioning element.

Even when the cleat comprises two motors, it may comprise a diverter element designed for preventing rope from entirely rolling up around said first towing element and/or a further diverter element designed for preventing rope from entirely rolling up around the second towing element. Preferably, the diverter element and/or said further diverter element comprises an arm at least partially protruding into said concave portion of the first towing element. Also, in this case, the diverter element and/or said further diverter element may comprise a concave portion designed to house the rope. Further, the diverter element may be fixed to said flange portion of the first positioning element or to deck and/or the further diverter element may be fixed on the second positioning element or to deck. Alternatively, the diverter element and/or the further diverter element may be fixed to the transverse element.

Preferably, the nautical cleat is provided with a connector designed for guiding the rope moving between the first towing element and the second towing element.

Even when the cleat is provided with two motors, the first part and the second part of at least one, preferably of both, of the towing elements are placed at a variable distance one from the other, in order to house ropes with different diameters therethrough. Preferably, a spring is located upwardly or downwardly said at least one of said towing elements in order to allow reciprocal approaching and departing of said first parts and second parts from each other.

According to a possible embodiment of the cleat, the transverse body comprises two additives protrusions designed for allowing tying the rope at a higher level.

The present disclosure also relates to a boat characterized in that it comprises a nautical cleat as disclosed herein.

In the present context, the terms "horizontal" and "vertical" are referred to the cleat before assembling thereof. As a matter of facts, when the cleat has been mounted and the boat is in the sea, the orientation of the cleat changes continuously.

BRIEF DESCRIPTION OF THE SEVERAL VIEWS OF THE DRAWINGS

Further features and advantages of the present disclosure will be clearer from the description of preferred but not exclusive embodiments of a nautical cleat, shown by way of examples in the accompanying drawings, wherein.

DETAILED DESCRIPTION

Figure 1:
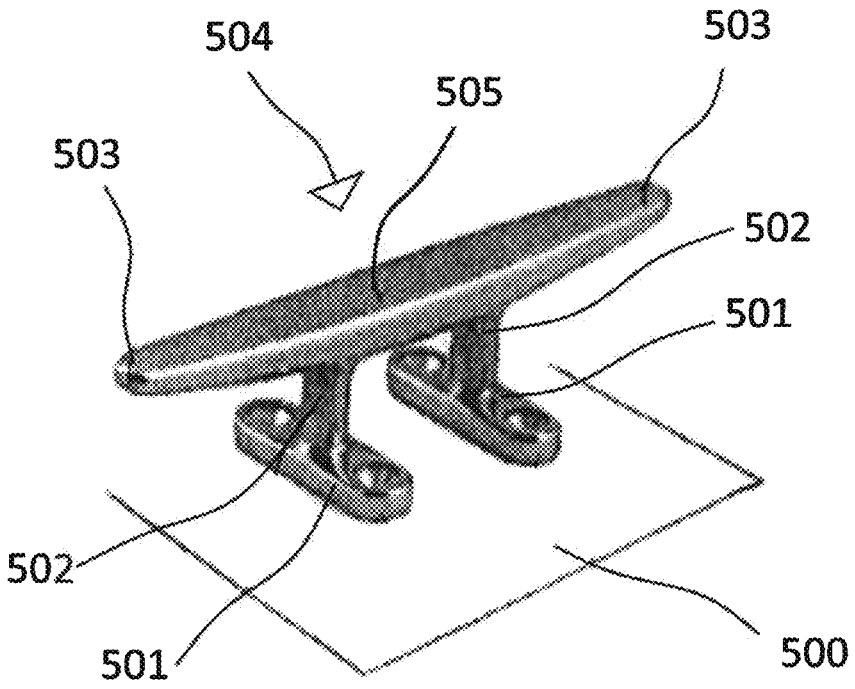
FIG. 1 is a perspective view of a nautical cleat according to the prior art.

With reference to the attached figures, a few possible embodiments of a nautical cleat 1, 1A for tying a rope 600 of a boat are herein described. In all the cases, cleat 1, 1A may be installed on a deck 300 of a vessel by means of a deck opening 400 through the same deck 300. The deck 300 comprises a deck upper surface 305 and a deck lower surface 306 (see FIG. 10).

Figure 7:
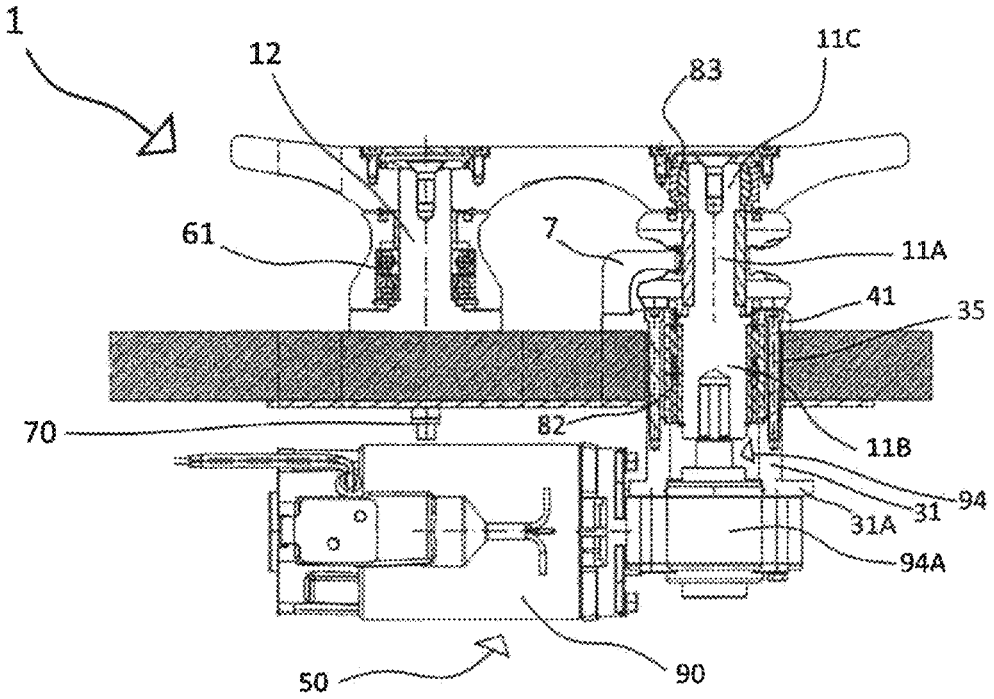
FIG. 7 is a longitudinal section view of the nautical cleat of FIGS. 4-6.

The cleat 1, 1A as disclosed herein comprises a first shaft 11 comprising an upper portion 11A, which terminates with an end portion 11C, and a lower portion 11B, visible in FIG. 7. Said first shaft 11 is installable on said deck 300 by means of a first positioning element 41. The cleat 1, 1A comprises also a second shaft 12 installable on said deck 300 by means of a second positioning element 42.

Figure 2:
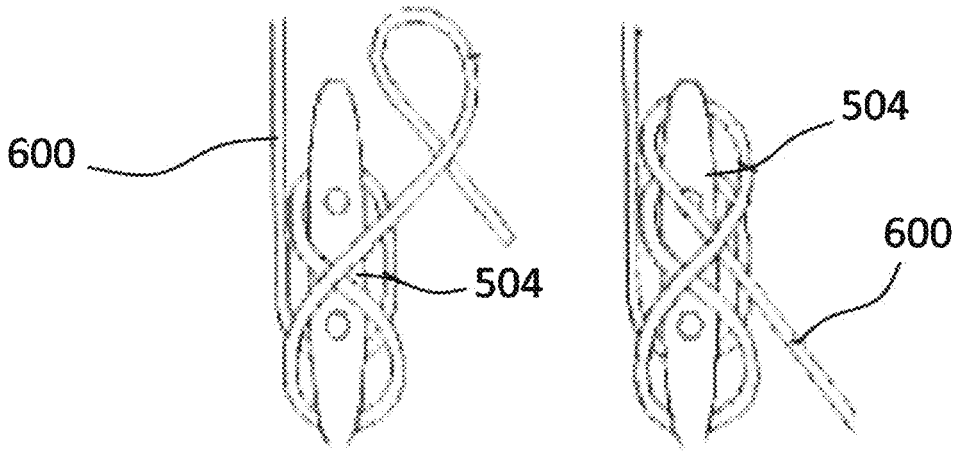
FIG. 2 shows two different modes to perform a cleat knot.
Figure 3:
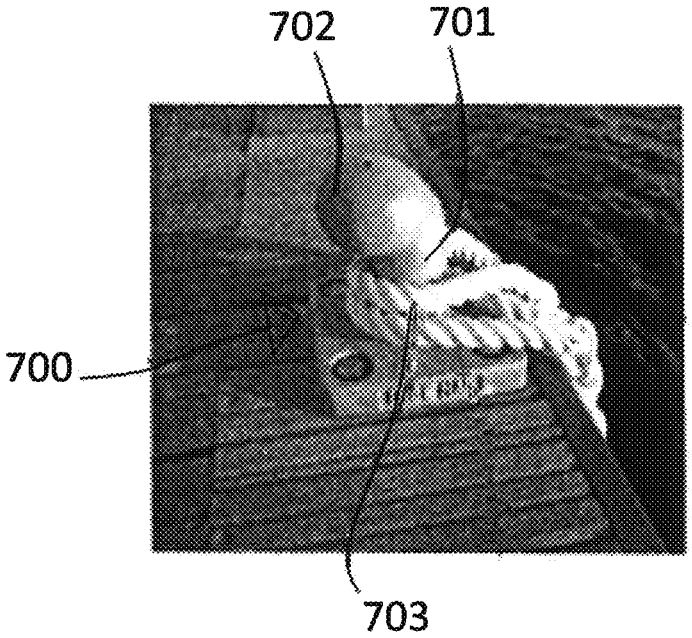
FIG. 3 is a perspective view of a bollard of the prior art.
Figure 4:
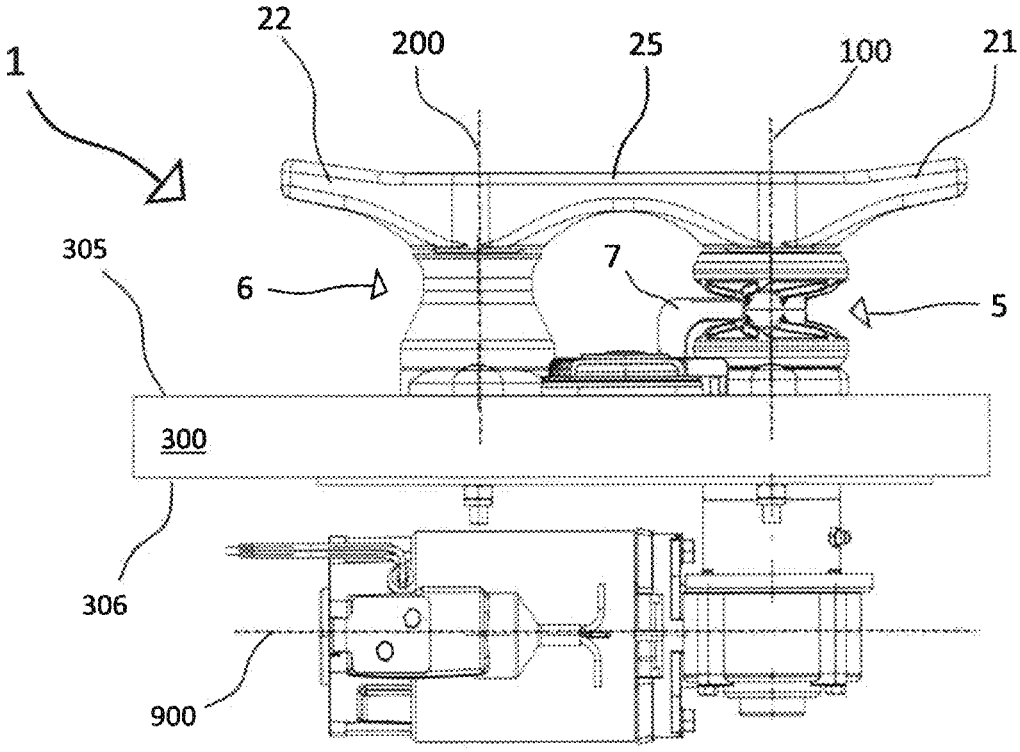
FIG. 4 is a side view of a first embodiment of a nautical cleat according to the present disclosure.
Figure 5:
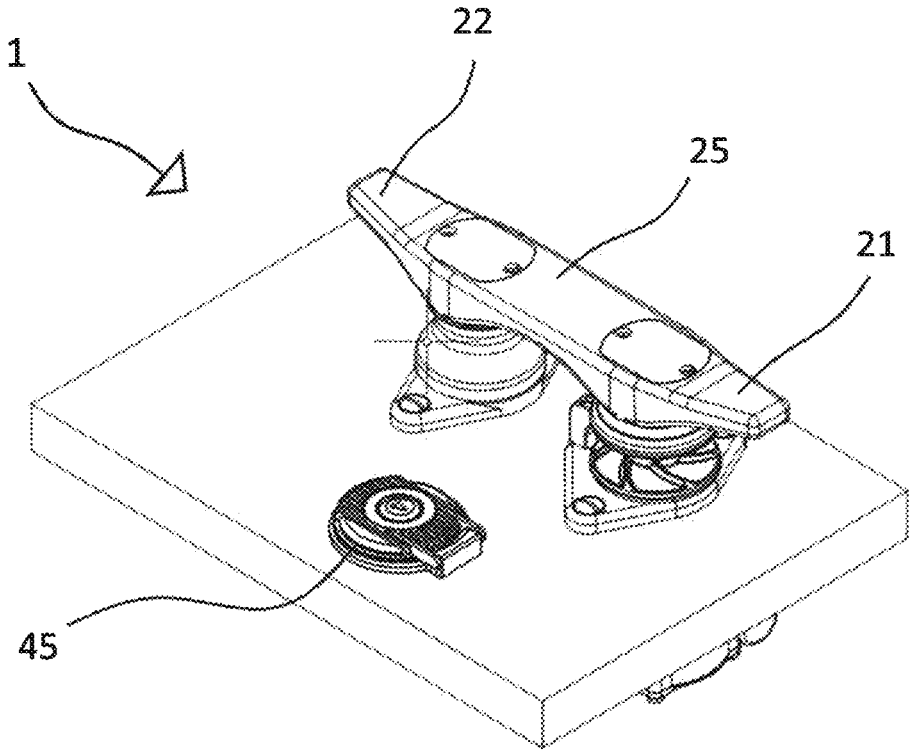
FIG. 5 is a perspective view of the nautical cleat of FIG. 4.
Figure 6:
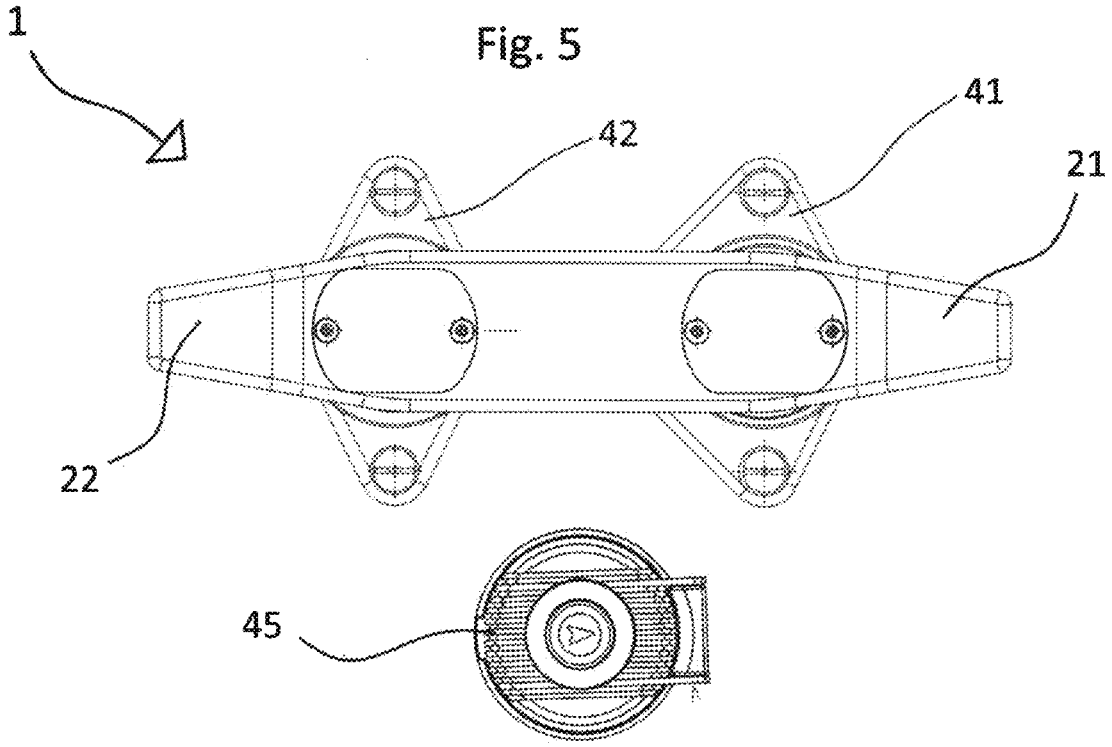
FIG. 6 is a top view of the nautical cleat of FIGS. 4 and 5.

The first shaft 11 and the second shaft 12, are mounted on deck 300 spaced apart one from the other. The first shaft 11 supports a first tying element 21, while the second shaft 12 supports a second tying element 22. Shafts 11 and 12 are substantially parallel to each other. The wording "first and second tying elements" means two elements by means of which it is possible to make a cleat knot, for example as the ones shown in FIG. 2. Through corresponding shafts 11, 12, the tying elements 21, 22 rise above the deck upper surface 305 of deck 300.

The cleat 1, 1A comprises a transverse body 25 mechanically connecting said first tying element 21 to said second tying element 22. It is preferably in the form of a bar orthogonal to the shafts 11, 12.

The cleat 1, 1A comprises also fastening means to securely fasten said first positioning element 41 and said second positioning element 42 to said deck 300. The fastening means has to be strong enough to keep shafts 11 and 12 of cleat 1, 1A firmly secured to deck 300 and to oppose the tensions transferred to shafts 11 and 12 during the mooring operation, while performing the cleat knot and after the cleat knot has been made. In other words, it can be said that the positioning elements 41 and 42 are the mechanical interfaces between shafts 11 and 12 and deck 300.

The cleat 1, 1A as disclosed herein may be characterized in that it comprises a first roller-shaped towing element 5 designed to tow and roll up the rope 600. In particular, said first towing element 5 is rotatable about a first rotation axis 100 defined by said first shaft 11.

The cleat 1, 1A as disclosed herein may also be characterized in that in comprises a second roller-shaped towing element 6 rotatable about a second rotation axis 200 defined by said second shaft 12. Said second rotation axis 200 is substantially parallel to said first rotation axis 100.

Preferably, both the first towing element 5 and the second towing element 6 are in the shape of a concave roller, i.e. a roller having a concave portion towards the corresponding rotation axis 100, 200. This concave portion aims to contain and to hold rope 600 while it is partially wrapped around the same roller, i.e. around the rotation axis 100, 200.

An actuating device 50 includes at least one motor 90 operatively connected to said first roller-shaped towing element 5 and/or to said second roller-shaped towing element 6 in order to allow the rotation thereof. The motor 90 is directly or indirectly connected to the towing element 5, 6. In the first case, the motor 90 directly grabs the towing element 5, 6. In the second case, one or more transmission component/s is/are provided in order to transfer the motion generated by motor 90 to the towing element 5, 6.

Connecting means may be designed for directly or indirectly connecting the actuating device 50 to said deck 300, so that said actuating device 50 is placed in a position underlying said deck lower surface 306.

A spherical joint 83, operatively interposed between the first shaft 11 and the transverse body 25, is designed to allow the rotation of the transverse body 25 with respect to said first shaft 11, about one or more substantially horizontal axis 800, 801. Preferably, joint 83 allows rotation of the transverse body 25 around horizontal axis 801, shown in FIG. 30, and horizontal axis 800, shown in FIGS. 26 and 27. Such axis 800 and 801 are perpendicular to each other. More preferably, any rotation obtained combining the two above rotations is allowed in the preferred embodiments of joint 83, in order to confer flexibility to cleat 1.

The spherical joint 83 preferably comprises an outer joint portion 83A, designed to be fixed to the transverse element 25, and an inner joint portion 83B, placed inside the outer joint portion 83A and designed to be fixed to the first shaft 11, as better visible in FIGS. 24-27. The outer joint portion 83A has the shape of a cylinder with an inner cavity able to house the inner joint portion 83B. The latter has also an inner cavity in order to house the first shaft 11 and has an inner surface which is substantially cylindrical and an outer surface which is substantially spherical. The inner cavity of the outer joint portion 83A is spherically shaped. The outer surface of the inner joint portion 83B may have substantially the same height of the inner surface of the outer joint portion 83A or slightly greater, as the one shown in the embodiment of FIGS. 24 to 26, or it may be shorter than outer joint portion 83A, as the one shown in the embodiment of FIG. 27. The inner surface is connected to the outer surface of the inner joint portion 83B by means of a fitting portion.

Figure 13:
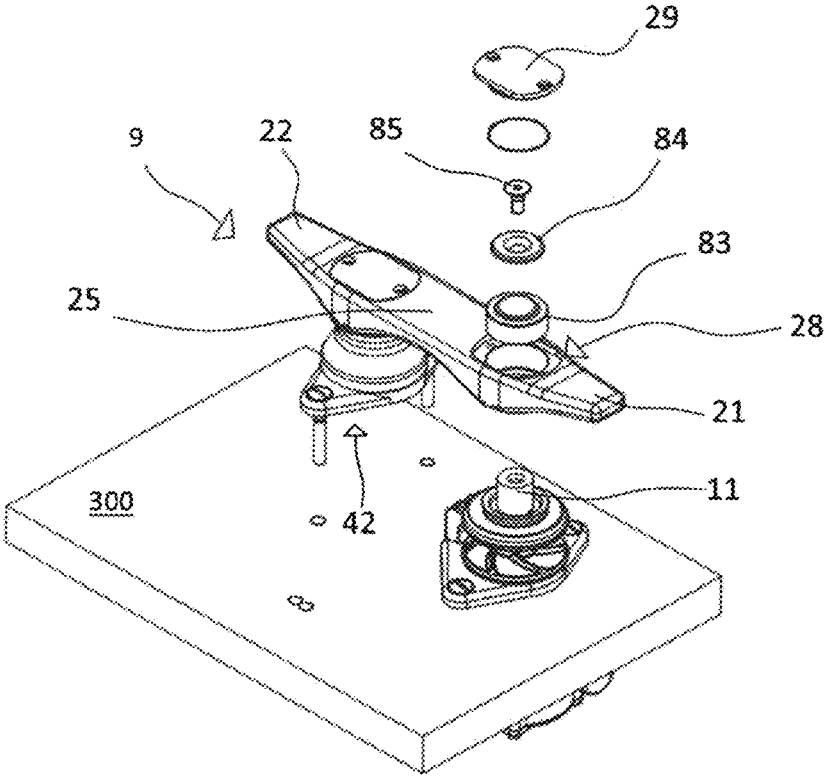

Preferably, a locking plate 84 screwed by means of a screw 85 at the top of the first shaft 11 is provided to hold joint 83 in position (see FIG. 13).

Joint 83 achieves compensating the curvatures of the deck 300. As a matter of fact, it allows the transversal body 25 to rotate about horizontal axis 801 of an angle $\alpha$ (appreciable in FIGS. 14, 26 and 27), adjusting the same transverse body 25 with respect to the curve of the deck 300 in a first direction. Furthermore, it allows the transversal body 25 to rotate about horizontal axis 800 of an angle $\beta$ (appreciable in FIGS. 30 and 8) adjusting the same transverse body 25 with respect to the curve of the deck 300 in a second direction orthogonal to the first one, thus avoiding tensioning and breaking the cleat 1, 1A. Angles $\alpha$ and $\beta$ are preferably comprised between 0° and 10°.

Figure 8:
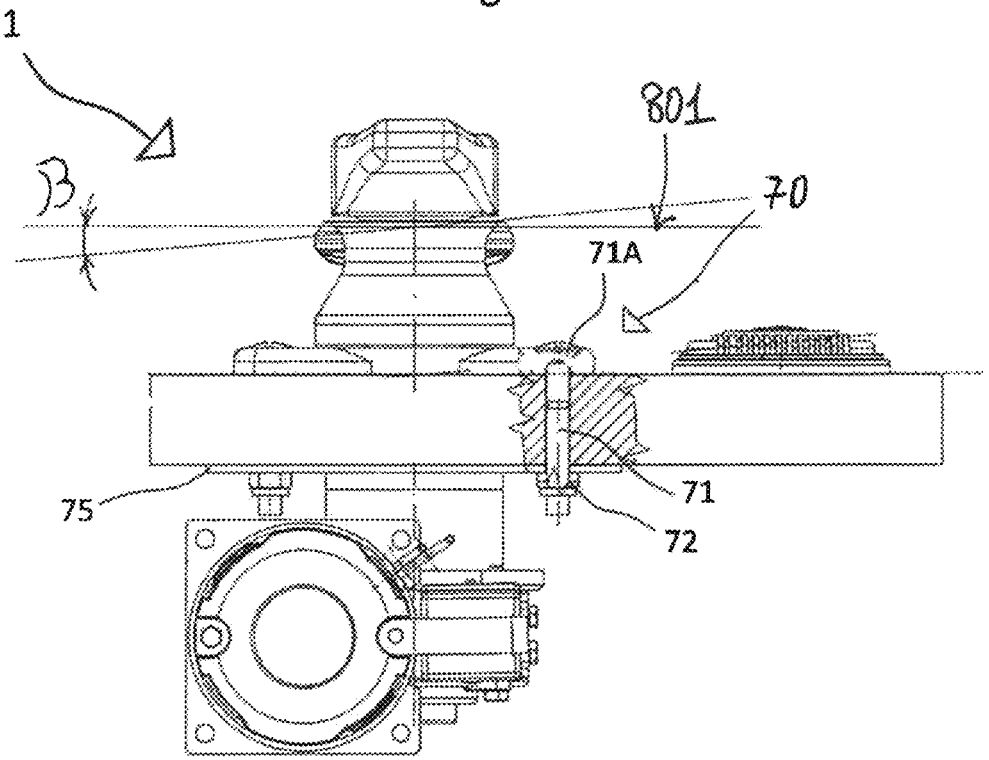
FIG. 8 is a rear view of the nautical cleat of FIGS. 4-7 partially sectioned.
Figure 14:
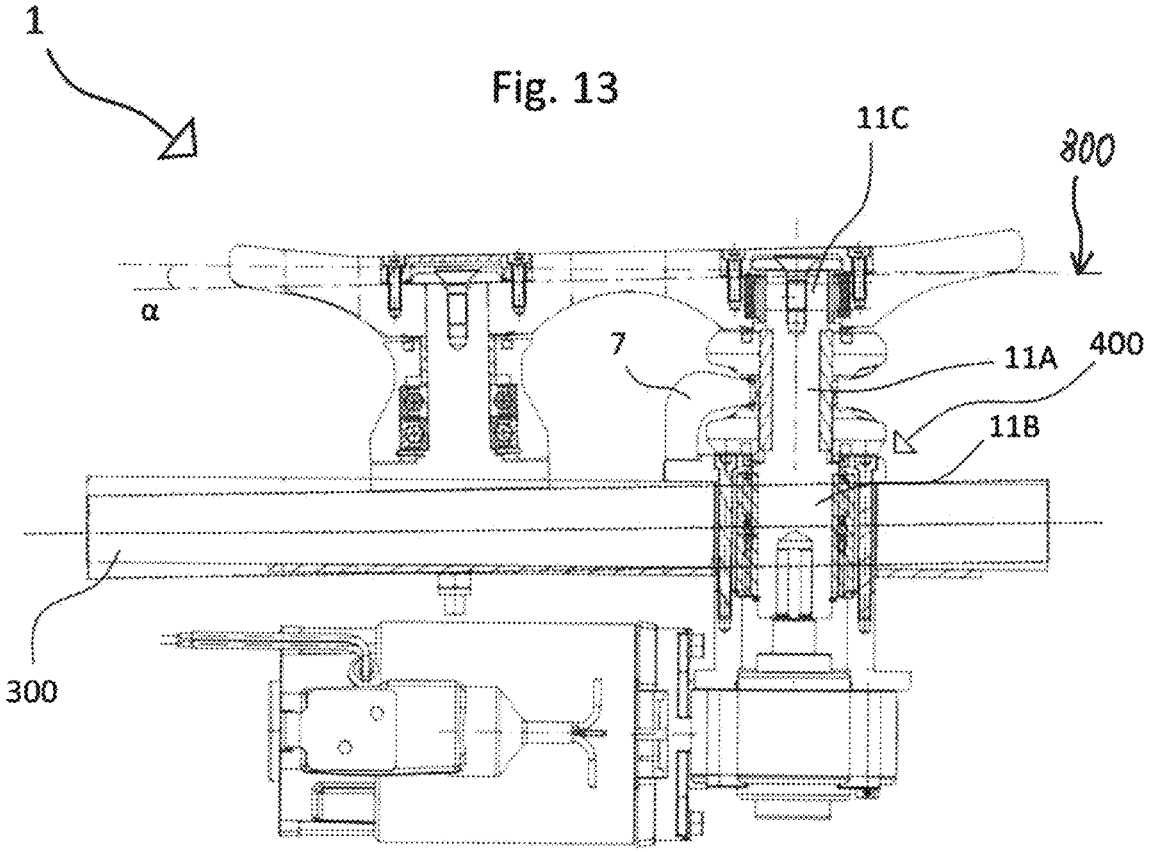
FIG. 14 is a further longitudinal section view of the cleat of FIGS. 4-9, illustrating adjustment of the cleat to the surface of the deck.
Figure 26:
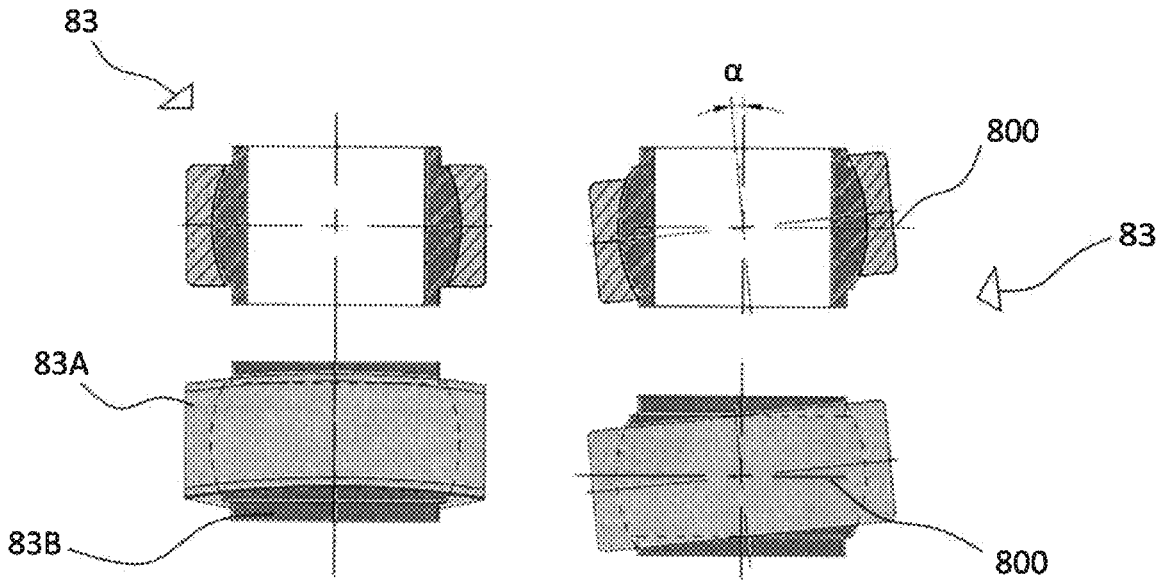
FIG. 26 shows two sectional views and two corresponding front views of the joint of FIGS. 24 and 25 in two different positions.
Figure 27:
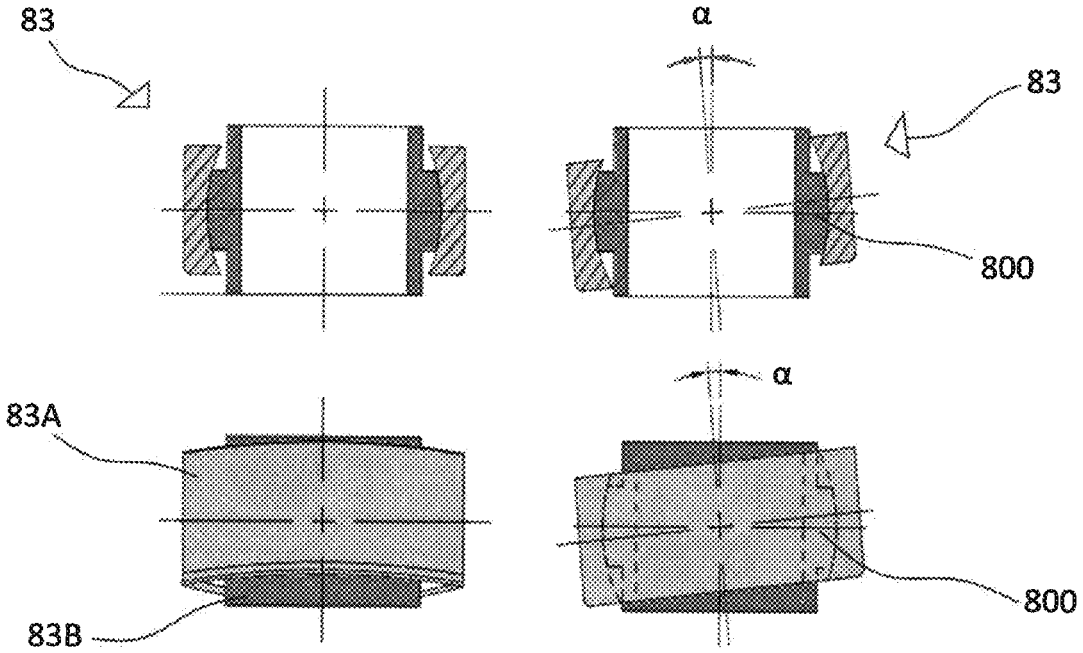
FIG. 27 shows two sectional views and two corresponding front views of a joint according to a further embodiment of the present disclosure in two different positions.
Figure 30:
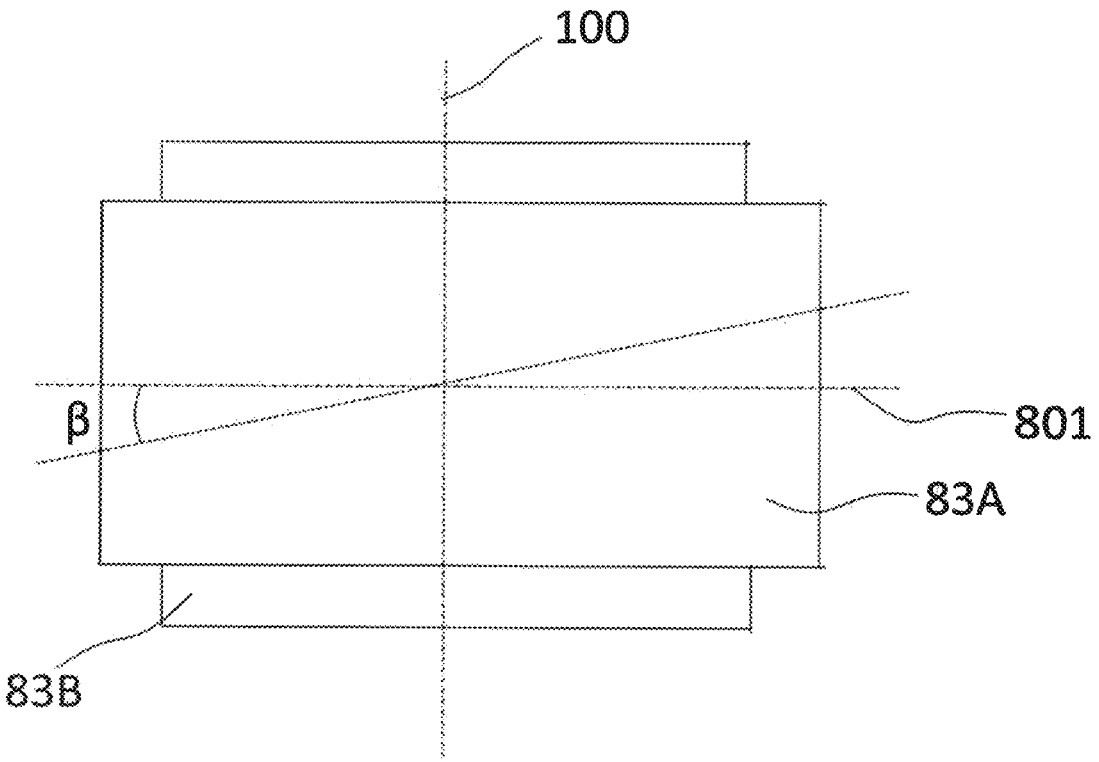
FIG. 30 is a lateral view of the joint of FIGS. 24-26.

For the sake of clarity, it is to be noted that the rotation of the transversal body 25 about axis 801 illustrated in FIG. 30 (of an angle $\alpha$) can only be appreciated in FIGS. 14, 26 and 27, while the rotation of the transversal body 25 about axis 800 illustrated in FIGS. 26 and 27 (of an angle $\beta$) can only be appreciated in FIGS. 8 and 30.

Moreover, it is to be noted that the spherical joint 83, as illustrated in the figures, allows rotations of the transverse body 25 around many axes, as known for a skilled in the art. Indeed, the spherical joint 83 is only a preferred embodiment which may be replaced by any device able to allow the rotation of the transversal body 25 about a horizontal axis, or better about an axis orthogonal to first rotation axis 100.

Preferably, the first positioning element 41 is installable in proximity to a deck pass-through opening 400 defined through said deck 300. Moreover, the connecting means comprises connecting screws 35 suitable for passing through said opening 400 in order to connect said actuating device 50 to said first positioning element 41 and to support the same actuating device 50 underneath the deck lower surface 306.

Advantageously, the connection between the first positioning element 41 and the actuating device 50 is carried out by means of the same opening 400 through the deck 300. At the same time, the same opening 400 is used to operatively connect the first towing element 5 to motor 90. The towing element 5 highly ease the mooring operation since it allows to tow and wrap up the rope without any effort. Actually, the sailor only has to perform a cleat knot using the two tying elements 21, 22.

When only the first towing element 5 is motorized, as in the embodiments shown in FIGS. 1-18, suitable bearings 61 are used to allow the rotation of the second towing element 6 around the second shaft 12 fixed to deck 300 by means of the second positioning element 42. Preferably, second shaft 12 and second positioning element 42 are joined together to form a single piece.

When both the towing elements 5, 6 are motorized, as in the embodiments shown in FIGS. 19-22, the constructive details of the second towing element 6, as the connecting means thereof, are preferably similar to that of the first towing element 5.

Figure 28:
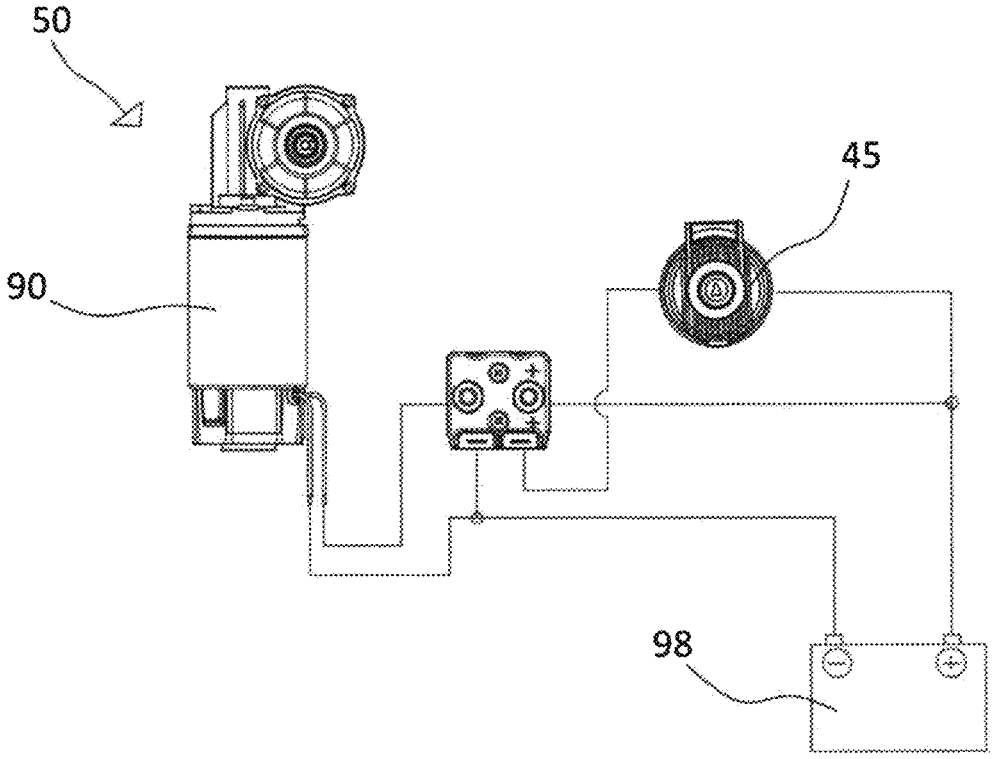
FIG. 28 is wiring diagram of an actuating device of a nautical cleat according to the first four embodiments of the present disclosure.

Motor 90 of the actuating device 50 is controlled by an actuation button 45, preferably of the foot-operated type, rising from the deck upper surface 305. In this regard, FIG. 28 schematically shows a control mode of the actuating device 50 whose electrical motor 90 is supplied by a power battery 98. Actuation button 45 controls the activation and deactivation of motor 90, i.e. of first towing element 5 operatively connected thereto. Advantageously, also battery 98 may be located underneath deck 300 so to not take up space above the same deck 300.

Figure 19:
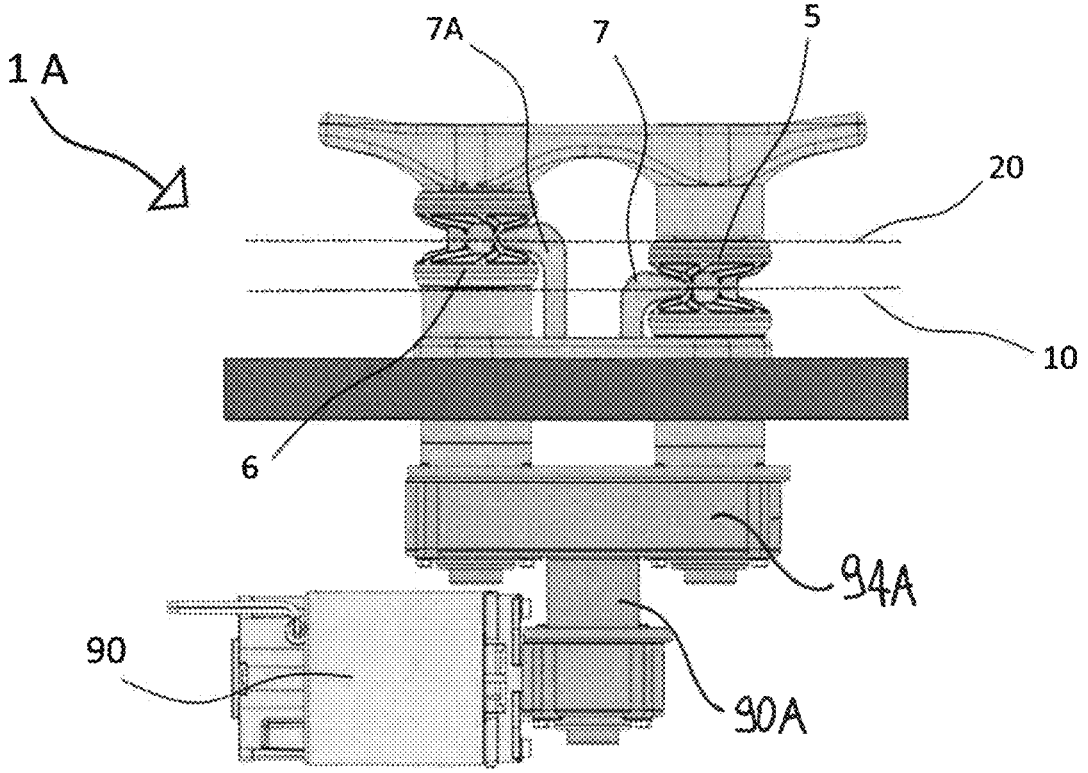
FIG. 19 is a side view of a nautical cleat according to a fifth embodiment of the present disclosure.
Figure 20:
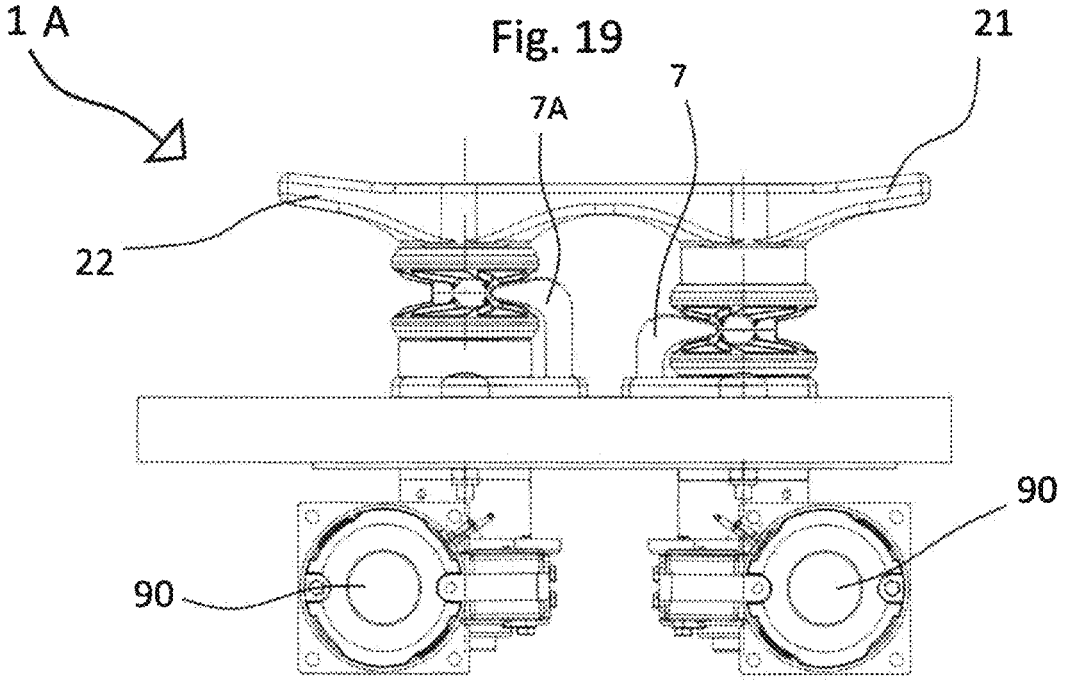
FIG. 20 is a side view of a nautical cleat according to a sixth embodiment of the present disclosure.
Figure 29:
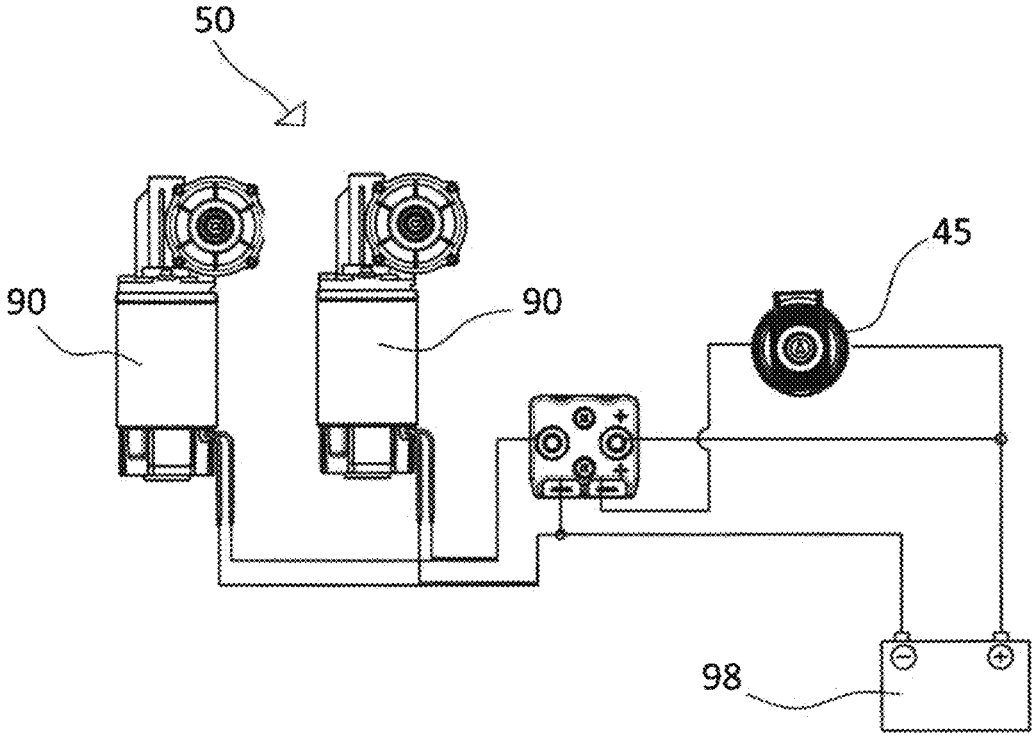
FIG. 29 is a wiring diagram of an actuating device of a nautical cleat according to embodiments 5th-8th of the present disclosure.

In the embodiment illustrated in FIG. 19, both towing elements 5, 6 are motorized, as mentioned before. In this case, both of them are driven by the same motor 90. On the contrary, in the embodiments shown in FIGS. 20-22, the actuating device 50 comprises two motors 90, a first one operatively connected to the first towing element 5 and a second one operatively connected to the second towing element 6. Preferably, said two motors 90 are actuated by a single actuation button 45. FIG. 29 schematically shows a control mode of the actuating device 50 whose two electrical motors 90 are supplied by a power battery 98. Actuation button 45 controls the activation and deactivation of the two motors 90, i.e. of both first towing element 5 and second towing element 6 operatively connected thereto.

According to the embodiments shown in FIGS. 4-14, 16 and 19-23, the first rotation axis 100 defined by the first shaft 11 and/or the second rotation axis 200 defined by the second shaft 12 is substantially orthogonal to the motor/s rotation axis 900 of actuating device 50. Thereby, assuming cleat 1 being installed in a substantially horizontal position, the first rotation axis 100 and/or the second rotation axis 200 is substantially vertical, while the motor 90 is oriented so to have a horizontal axis.

Figure 15:
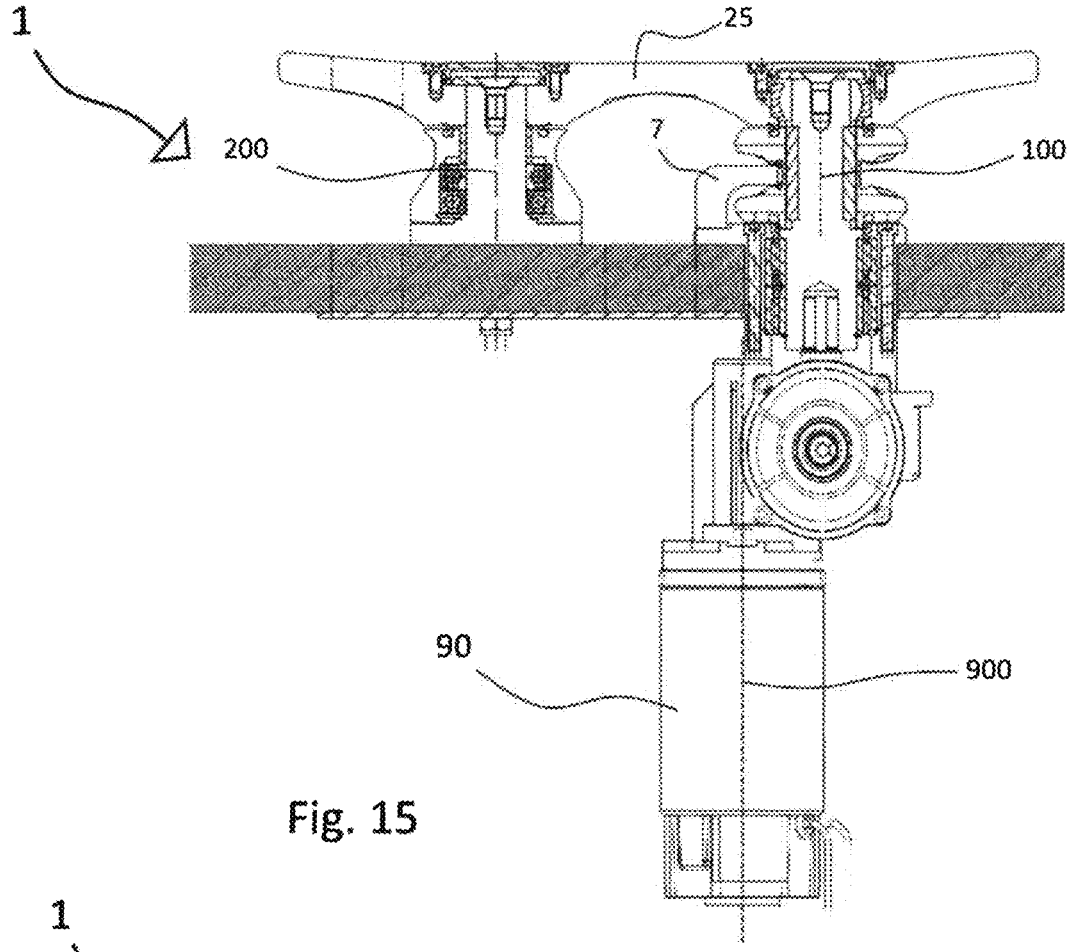
FIG. 15 is a longitudinal section view of a nautical cleat according to a second embodiment of the present disclosure.

On the contrary, considering the embodiment illustrated in FIG. 15, the first rotation axis 100 and the motor rotation axis 900 results to be parallel to each other. Therefore, assuming again cleat 1 being installed in a substantially horizontal position, the first rotation axis 100 and the motor rotation axis 900 result to be both in a substantially vertical position.

Starting from now, the description will be referred to the embodiments where only the first towing element 5 is motorized. However, as already mentioned, the same considerations relating to the first towing element 5 apply analogously to the second towing element 6 when it is motorized too.

Figure 11:
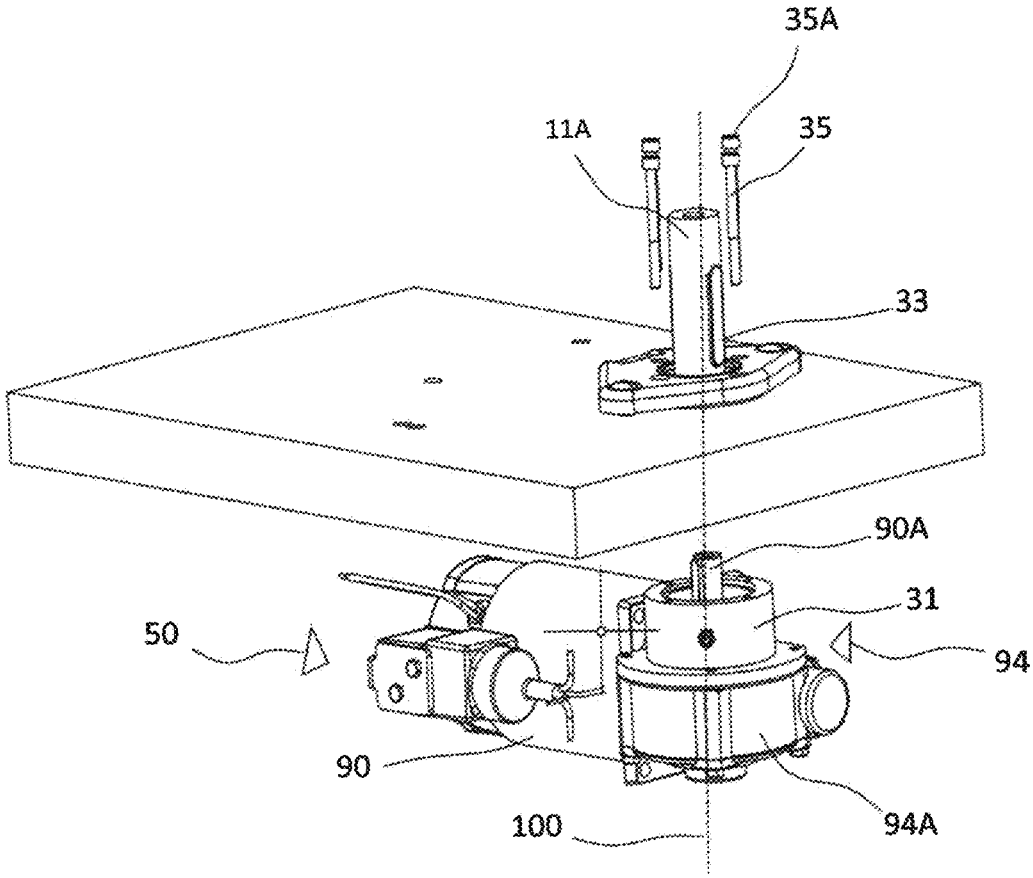

When the first shaft 11 rotates together with the first towing element 5, the same first shaft 11 is operatively connected to motor 90 by means of a mechanical transmission 94 (see FIG. 11). This latter may comprise a geared motor 94A, placed at the exit of the shaft 90A of motor 90. More generally, the mechanical transmission 94 may have different configurations.

As far as the positioning elements 41, 42 are concerned, they may have different configurations too. For example, in the embodiments illustrated in FIGS. 16-19 and 21-22, the first positioning element 41 and the second positioning element 42 are not physically separated, on the contrary they are defined by a single body constituted by a positioning plate 8 resting on the deck upper surface 305 and defining holes for fastening means to pass through.

In all the other embodiments, the first positioning element 41 and the second positioning element 42 are physically separated. Each of them is in the form of a flange portion 41A, 42A resting over the deck upper surface 305, and a centring body 41B, 42B (see FIGS. 10 and 13). The positioning element 41, 42 are fixed to deck 300 by means of fastening means, preferably comprising a plurality of bolts 70, visible in FIGS. 8 and 10. With reference to these figures, a bolt 70 comprises a screw 71 passing through a hole 81 (which passes through deck 300) in order to come out below deck 300. The screw 71 has a head 71A, lying against the surface of the corresponding positioning plate, and a nut 72 tightened against a plate 75 underlying the deck lower surface 306.

Preferably, the first shaft 11 is rotatable around the first rotation axis 100 and is coaxial with the first towing element 5. In particular, the first towing element 5 surrounds an upper portion 11A of the first shaft 11 and rotates together with it by means of a transmission element 33, preferably a mechanical shaft key, visible in FIG. 11. As already mentioned, the first shaft 11 is operatively connected to motor 90.

As mentioned above, the first positioning element 40 comprises a flange portion 41A resting over the deck upper surface 305 in the nearby of the deck opening 400 passing through deck 300. The flange portion 41A is internally hollow and passed through by first shaft 11. A lower portion 11B of the first shaft 11 passes through deck opening 400 (see FIG. 14).

Figure 10:
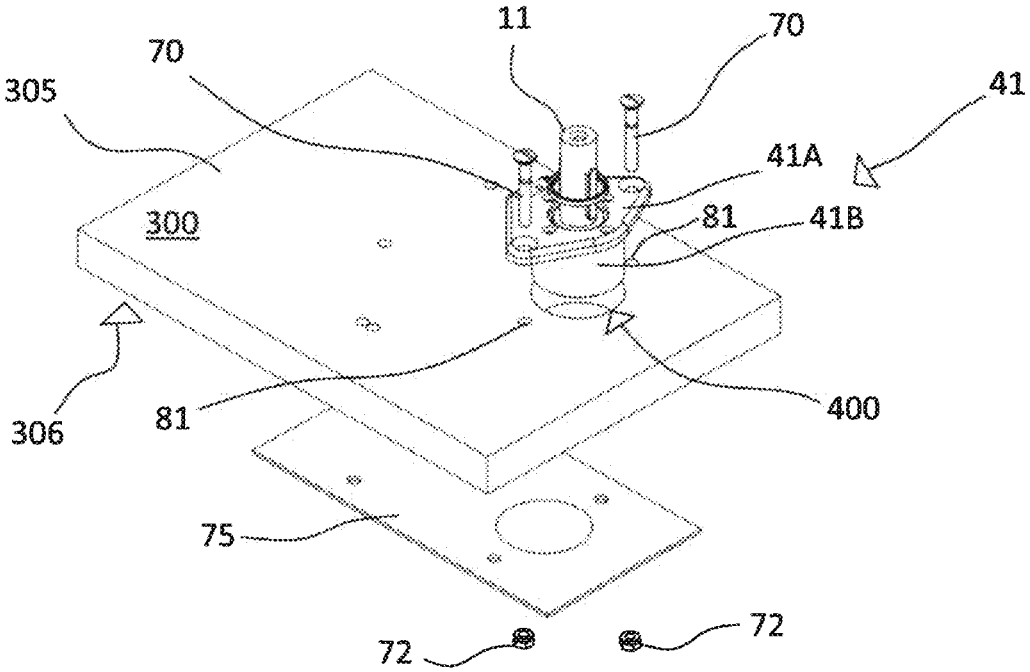
FIGS. 10-13 are exploded view representing consecutive installation steps of the nautical cleat of FIGS. 4-9 on a deck of a boat.

Still referring to FIG. 10, the centring body 41B of the first positioning element 41, develops starting from the flange portion 41A downwardly, in order to intrude within deck opening 400. In particular, the centring body 41B has a geometrical shape corresponding to that of the deck opening 400, in order to pass therethrough. Preferably, the deck opening 400 has a circular shape and the centring body 41B has a cylindrical conformation with a diameter substantially corresponding to that of deck opening 400. This helps the cleat 1, 1A assembling steps, as will be better explained in the following.

The centring body 41B comprises an inner axial cavity preferably passed through by the lower portion 11B of the first shaft 11 which is coaxial therewith. Alternatively, the axial cavity may be passed through by transmission elements while the first shaft 11 may develops only partially therein.

The first positioning element 41 supports the actuating device 50 by means of connecting means which comprises a connecting body 31, internally hollow, connected to the actuating device 50. The connecting means further comprises a plurality of connecting screws 35 axially inserted within the centring body 41B and designed to be screwed on the connecting body 31. The head 35A of the connecting screws 35 lies against the flange portion 41A of the first positioning element 41 in order to support the connecting body 31 and thus also the actuating device 50 connected thereto. The connecting body 31 comprises a flange portion 31A aimed at fixing the connecting body 31 to the actuating device 50 (see FIGS. 7 and 11).

This is one of the different possible configurations of the connecting means in order to connect the first positioning element 41 to the actuating device 50.

In order to allow the rotation of the first shaft 11 with respect to the first positioning element 41, bearings 82 (noticeable in FIG. 7) are arranged within the axial cavity defined by the centring body 41B. More particularly, bearings 82 allows rotation of the first shaft 11 about the first rotation axis 100. To support bearings 82 different technical solutions may be provided.

As it may be seen from FIG. 13, transverse body 25 is provided with two openings 28 aiming at allowing the positioning thereof on the two shafts 11, 12 of cleat 1, 1A. One of the two openings 28 aims also at allowing positioning the spherical joint 83. When the transverse body 25 and the joint 83 are positioned, the openings 28 are closed by means of suitable covering elements 29.

With reference to the embodiment illustrated in FIG. 19, where both towing elements 5, 6 are motorized and are driven by the same motor 90, a transmission unit 94A between the motor 90 and the two shafts 11, 12 ensures that these two rotates at the same rate, as it is apparent for a skilled in the art. For example, the transmission unit 94A may comprise a gear wheel, on the exiting shaft 90A of the motor 90, that engages a first gear wheel (or other gear mechanism) integral with the first shaft 11 and a second gear wheel (or other gear mechanism) integral with the second shaft 12.

According to the preferred embodiments illustrated in the figures, the towing element 5 has a concave roller configuration defined by a first part 5A and by a second part 5B substantially symmetrical with respect to a plane substantially orthogonal to said first axis 100. Each of said parts 5A, 5B comprises a gripping surface 5C (see FIG. 12) tapered in the direction of said first axis 100. First part 5A and second part 5B are placed in such a way that the two gripping surfaces 5C are reciprocally facing so as to define, when the two parts 5A, 5B are joined together, the concave portion of said first towing element 5. Preferably, each of two gripping surfaces 5C is provided with ribs 5D which aim to further help the grip of the mooring rope 600. Thanks to this specific conformation of the towing element 5 and as a result of its rotation, rope 600 is pulled in the centre of the concave portion of the first towing element 5, where its diameter is smallest.

Figure 9:
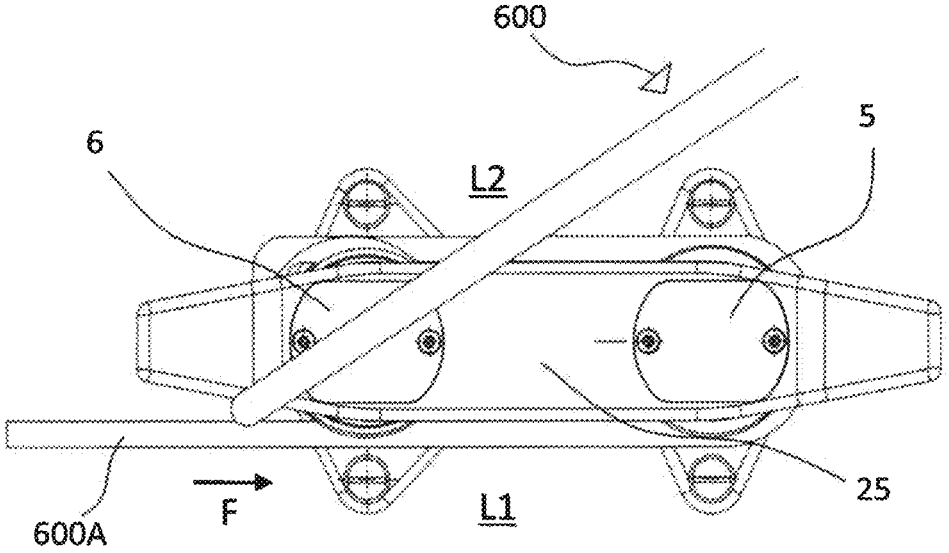
FIG. 9 is a further top view of the nautical cleat of FIGS. 4-8 wherein a mooring rope has been illustrated.

Altogether, when rope 600 is at least partially wrapped around the first towing element 5 and the latter is actuated, the same rope 600 is clamped in a vice between the two parts 5A, 5B of the first towing element 5. In this way, the rope 600 is tensioned in the portion 600A comprised between the anchoring point (quay or dead weight) and the first towing element 5, as shown in FIG. 9.

Advantageously, when the mooring operation results to be concluded, the portion 600A of rope 600 remains tensioned since the first towing element 5 is blocked by motor 90.

As already mentioned, the towing element 5 comprises a concave portion defined by two opposing gripping surfaces 5C, which are opposing with respect to a plane orthogonal to the first rotation axis 100 and which may have different sizes and/or shapes. Said gripping surfaces 5C are configured so as to clamp rope 600 in a vice thanks to the rotation of the first towing element 5 and to the partial wrapping of the rope 600 around the same first towing element 5.

In order to prevent rope 600 from completely wrapping around the first towing element 5, nautical cleat 1, 1A, further comprises a diverter element 7. The latter prevent the rope 600 from rolling up around the first towing element 5 in such a way to describe an angle wider than 180°.

According to the embodiments shown in FIGS. 4-22, said diverter element 7 is in the form of an L comprising an arm at least partially protruding into said concave portion of the first towing element 5.

Figure 23:
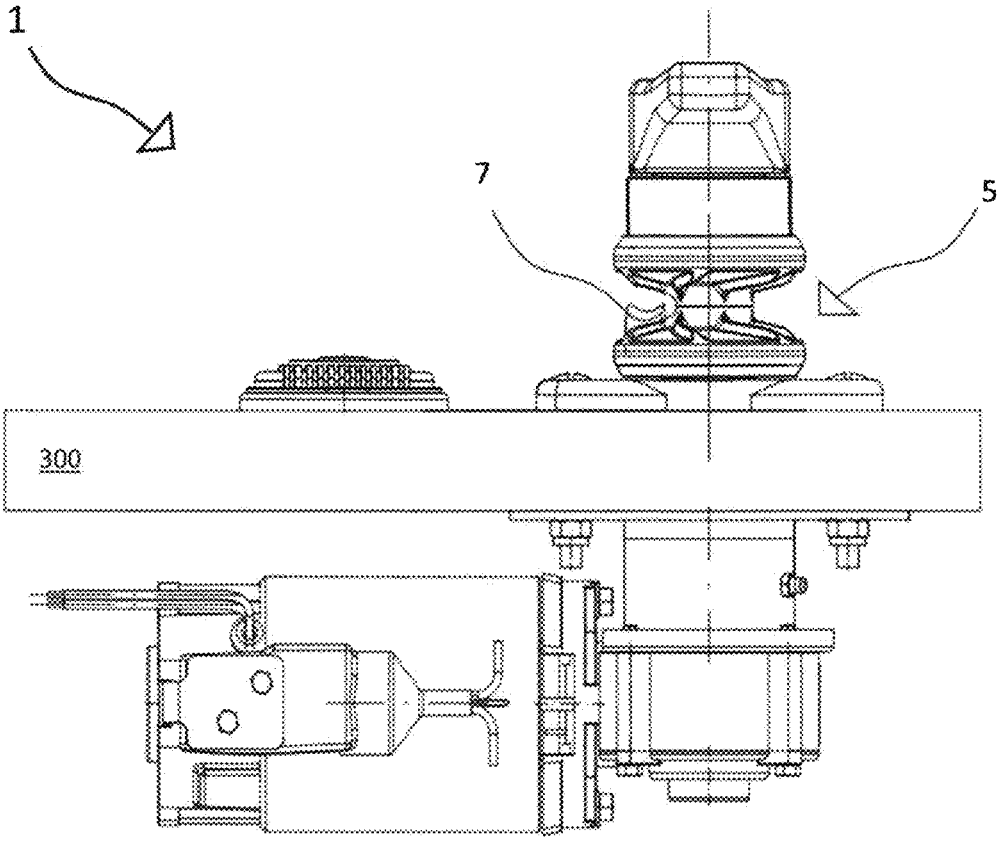
FIG. 23 is a front view of a nautical cleat according to a ninth embodiment of the present disclosure.
Figure 24:
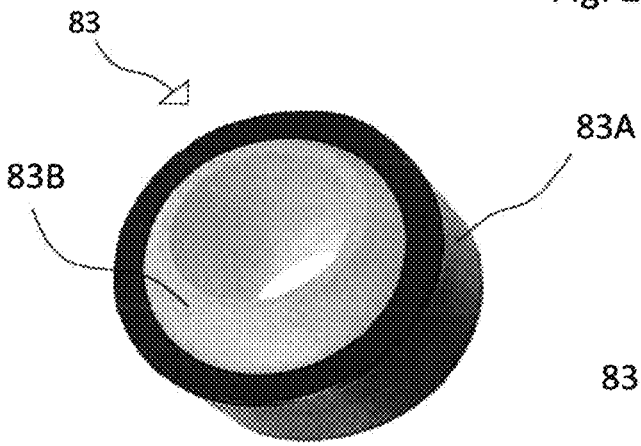
FIG. 24 is perspective view of a spherical joint of the nautical cleat according to a preferred embodiment of the present disclosure.
Figure 25:
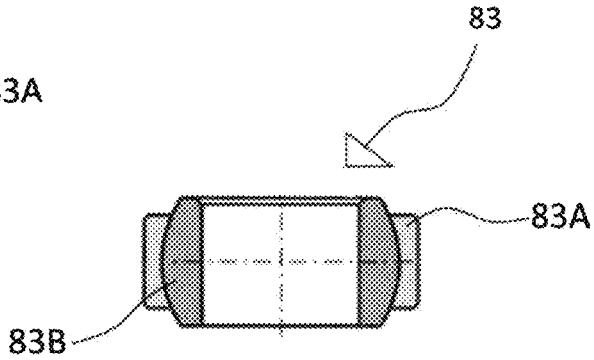
FIG. 25 is a sectional view of the joint of FIG. 24.

According to the embodiment of FIG. 23, said diverter element 7 comprises a concave portion designed to house the rope 600 therein.

Figure 16:
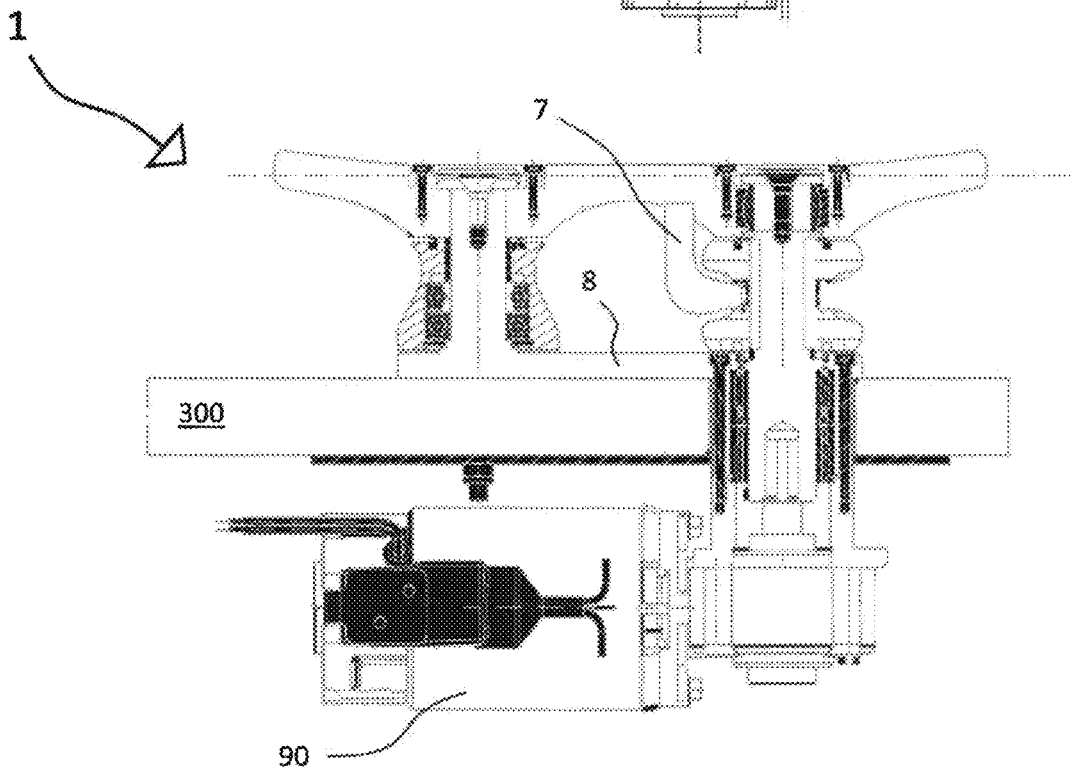
FIG. 16 is a longitudinal section view of a nautical cleat according to a third embodiment of the present disclosure.
Figure 17:
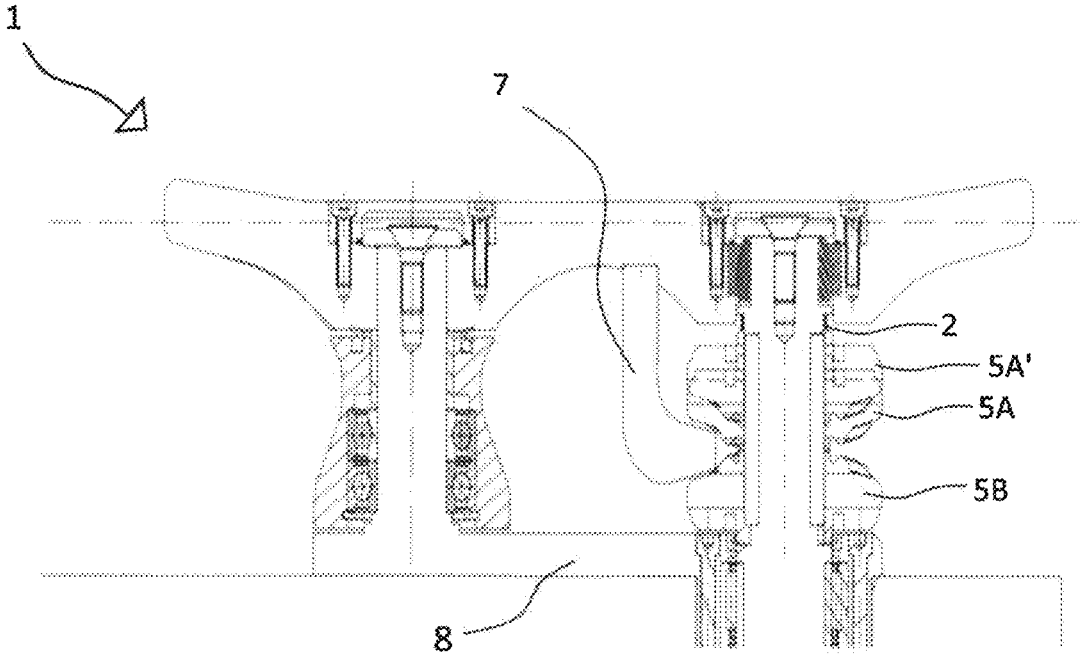
FIG. 17 is a longitudinal section view of a nautical cleat according to a fourth embodiment of the present disclosure.
Figure 18:
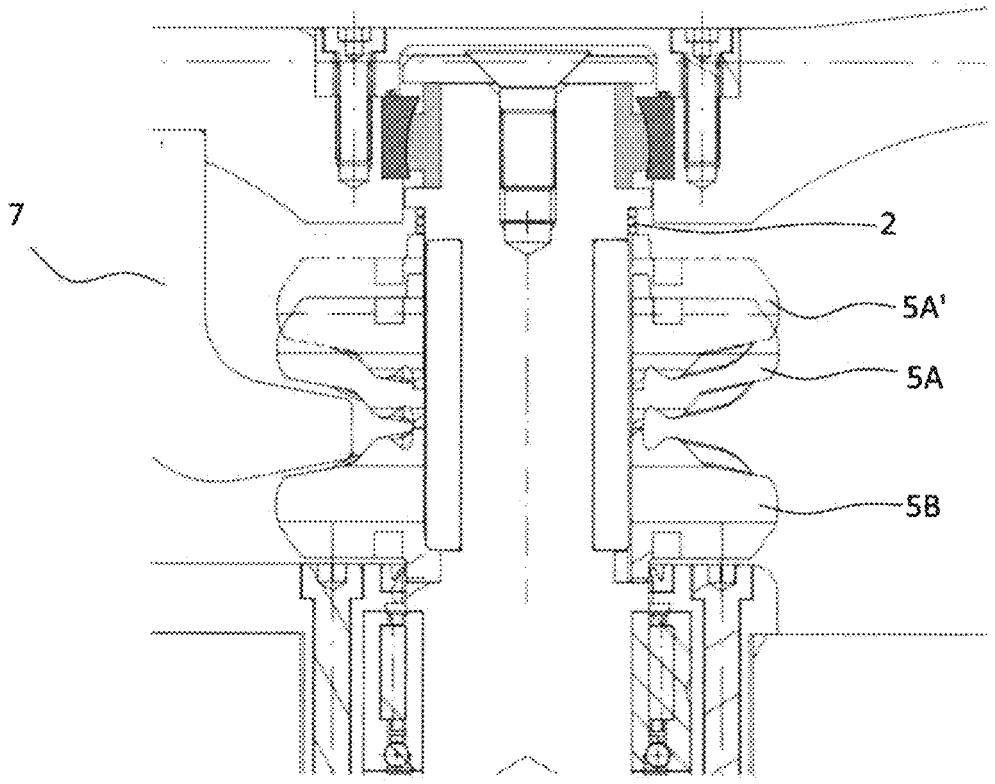
FIG. 18 is an enlarged view of a detail of FIG. 17.

The diverter element 7 is preferably fixed to the flange portion 41A of said first positioning element 41, as shown in FIGS. 4-15, or to the transverse element 25, as shown in FIGS. 16-18. However, it may be fixed also to the deck 300.

According to the embodiment shown in FIGS. 17 and 18, the first part 5A and the second part 5B of the first towing element 5 are placed at a variable distance one from the other, in order to house ropes 600 with different diameters therethrough.

In this case, preferably, the nautical cleat 1, 1A further comprises a spring 2 located upwardly or downwardly said first towing element 5 in order to allow reciprocal approaching and departing of said first part 5A and second part 5B from each other. In particular, FIGS. 17 and 18 illustrates the presence of a spring 2, located above the first towing element 5. These figures show first part 5A in a first position, suitable to house a thinner rope 600, and first part 5A' in a second position in order to house a thicker rope 600.

With reference to FIGS. 10-13, hereinafter a process for installing the nautical cleat 1 of FIGS. 4-9 and 14-17 on a boat will be described according to a preferred procedure.

Referring to FIG. 10, firstly holes 81 for bolts 70 and opening 400 passing through the two surfaces 305 and 306 are defined through deck 300. The first positioning element 41 is installed above deck 300. More particularly, the flange portion 41A is fixed to deck 300 by means of bolts 70, while the centering body 41B is inserted through the pass-through opening 400. The flange portion 41A is fixed by means of plate 75 which contacts the deck lower surface 306.

In a second installing step (FIG. 11), the assembly made up of the actuating device 50 and the connecting body 31 is fixed to the centering body 41B by means of relevant connecting means. More specifically, connecting screws 35 are inserted in cavities obtained through the centering body 31 and screwed in corresponding threaded housings defined in the connecting body 31. Subsequently, the assembly is suspended in a position underlying the deck lower surface 306 and preferably adjacent thereto. Subsequently, the first shaft 11 is inserted in the axial cavity obtained in the centering body 41B and/or in the connecting body 31. In particular, at its lower end, the first shaft 11 is connected to the mechanical transmission 94. More particularly, with its lower end, the first shaft 11 engages the exiting shaft 90A of the geared motor 94A which is, in its turn, connected to motor 90. In this step, also bearings 82, aimed at allowing rotation of the first shaft 11 (about the first rotation axis 100) with respect to the first positioning element 41, are assembled.

Figure 12:
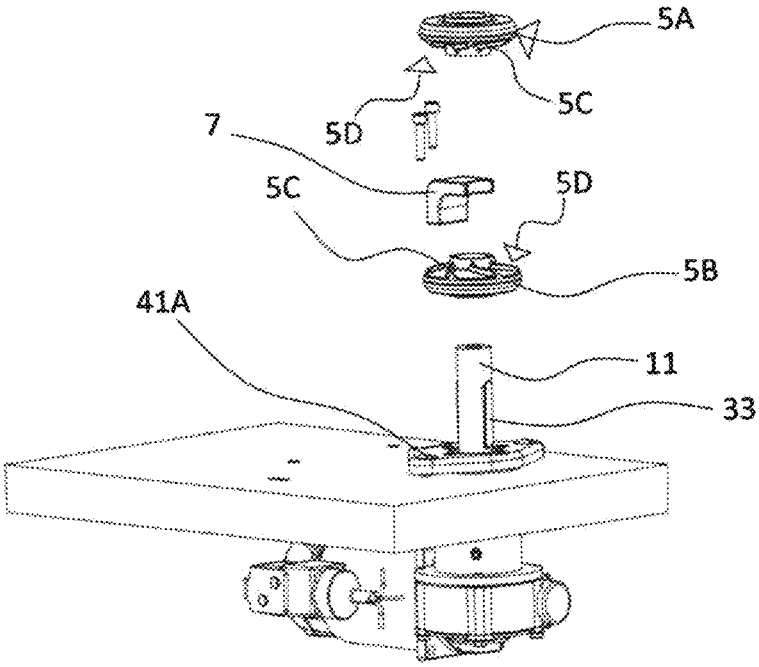

Referring now to FIG. 12, once the first shaft 11 has been installed in the operative position, first part 5A and second part 5B of the first towing element 5 are inserted in the same first shaft 11 in such a way to result connected thereto by means of the transmitting element 33. Preferably, the second part 5B (the lower one) is firstly inserted in the first shaft 11 and connected thereto, then the diverter element 7 is fixed on the flange portion 41A of the first positioning element 41. Afterwards, the structure of the first towing element 5 is completed by inserting the first part 5A (the upper one) in the first shaft 11 and by connecting it to the transmitting element 33.

Once the structure of the first towing element 5 has been completed, the second positioning element 42 and the second shaft 12 are installed on deck 300. Preferably, these two components are previously assembled to form a single body which is afterward mounted on deck 300 in order to simplify the procedure.

The last installing step is illustrated in FIG. 13. In particular, this figure shows the installation of the transverse body 25, defining the first tying element 21 and the second tying element 22 over the two top ends of the corresponding first shaft 11 and second shaft 12 of nautical cleat 1. To this purpose openings 28, obtained in the transverse body 25, are used. The spherical joint 83, allowing rotation of the transverse body 25 about a horizontal axis, is mounted in the opening 28 of the transverse body 25. This joint 83 is hold in position by means of a locking plate 84 and a fixing screw 85. Transverse body 25 may be previously connected to the second shaft 12 in order to form an assembly 9 of components, i.e. a single piece component. This assembly 9 may be advantageously installed on deck 300 throughout a single action which is fixing the second positioning element 42 to deck 300.

FIG. 9 permits appreciating the functioning principles of cleat 1 and the advantages derivable therefrom. Before starting the mooring operation, a sailor prepares a rope 600, not yet tensioned, around shafts 11, 12 of cleat 1. More particularly, rope 600 is rolled up around the first towing element 5 forming an angle of about 180°. To this regard, an entering side in the first towing element 5 (indicated by L1 in FIG. 9) and an outgoing side from the same first towing element 5 (indicated by L2 in the same figure), with respect to the transverse body 25, are individuated.

The rope 600 going out from the first towing element 5 is directed towards the second towing element 6 which, in this embodiment, is idle and rotatable about the second shaft 12. The rope 600 is partially wrapped around the second towing element 6 and arises above the transverse body 25 transversally towards the outgoing side L2. This is a preliminary disposition of rope 600 which helps the subsequent performing of the cleat knot.

By acting on actuation button 45, the first towing element 5 tows rope 600 in the direction indicated by arrow F in FIG. 9. Advantageously, the conformation of the first towing element 5 helps the grip of rope 600. The latter is directed by gripping surfaces 5C towards the first rotation axis 100 and is clamped in a vice between the same gripping surfaces 5C. The diverter element 7 prevents rope 600 from completely wrapping around the first towing element 5 and direct it towards the second towing element of the second shaft 12.

The towing action of rope 600 draws the boat towards the quay or other fixed point where the mooring rope 600 is lately fixed. The mooring operation is thus carried out by the sailor without any physical effort. As a matter of fact, he/she has only to retrieve the rope 600 staying, preferably, on outgoing side L2. In fact, during the mooring operation, the portion 600A of rope 600 standing in the entering side L1 is tensioned.

Once the sailor considers the mooring operation concluded, he/she deactivates the actuation button 45 thereby arresting the rotation of the first towing element 5 and deactivating motor 90. Thanks to the clamping action ensured by the first towing element 5 on the entering side L1, rope 600 keep being tensioned, while on the outgoing side L1, rope 600 is not tensioned. This allows the sailor to perform the cleat knot by using the two tying element 21, 22. Therefore, the cleat knot may be accomplished slowly and safely.

Analogously, also the kedging operation may be carried out using the same procedure, without any efforts and in safe conditions. As a matter of fact, the effort of towing rope 600 is carried out by the first towing element 5 (in the embodiments of FIGS. 19-22, also by the second towing element 6) motorized by the actuating device 50. In fact, the cleat 1, 1A of the present disclosure, highly simplify the mooring operation which turns out to be an easy task which may be carried out also by sailor without any ability or experience.

According to preferred embodiments as disclosed herein, the first towing element 5 and the second towing element 6 are vertically offset in order to avoid the rope 600 portion outgoing from the cleat 1, 1A from obstructing the rope 600 portion entering therein. This is particularly clear from FIG. 19 which shows a first horizontal axis 10 indicating the height of the first towing element 5 and a second horizontal axis 20 indicating the height of the second towing element 6, which is clearly different from the height of the first towing element 5.

As mentioned before, also the second towing element 6 may be operatively connected to motor 90, i.e. also the second towing element 6 may be motorized, as shown in the embodiments of FIGS. 19-22. With particular reference to these embodiments, cleat 1A as disclosed herein further comprises a further diverter element 7A designed for preventing rope 600 from entirely rolling up around the second towing element 6. The further diverter element 7A is illustrated in the embodiments of FIGS. 19-22.

Figure 21:
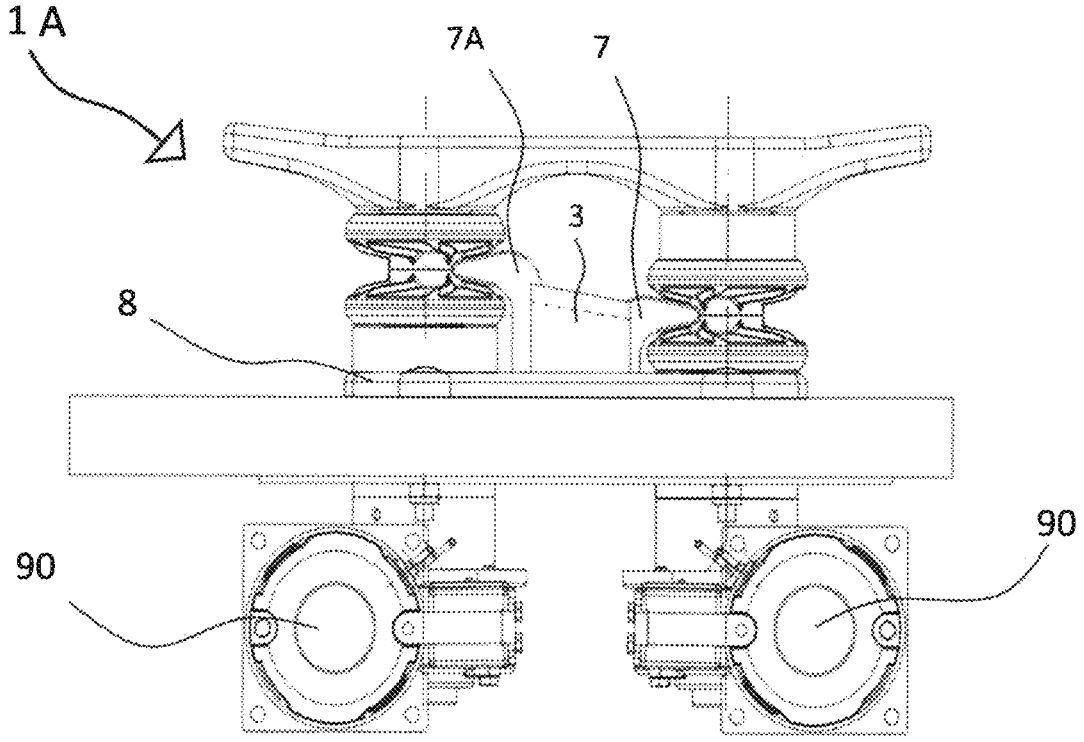
FIG. 21 is a side view of a nautical cleat according to a seventh embodiment of the present disclosure.
Figure 22:
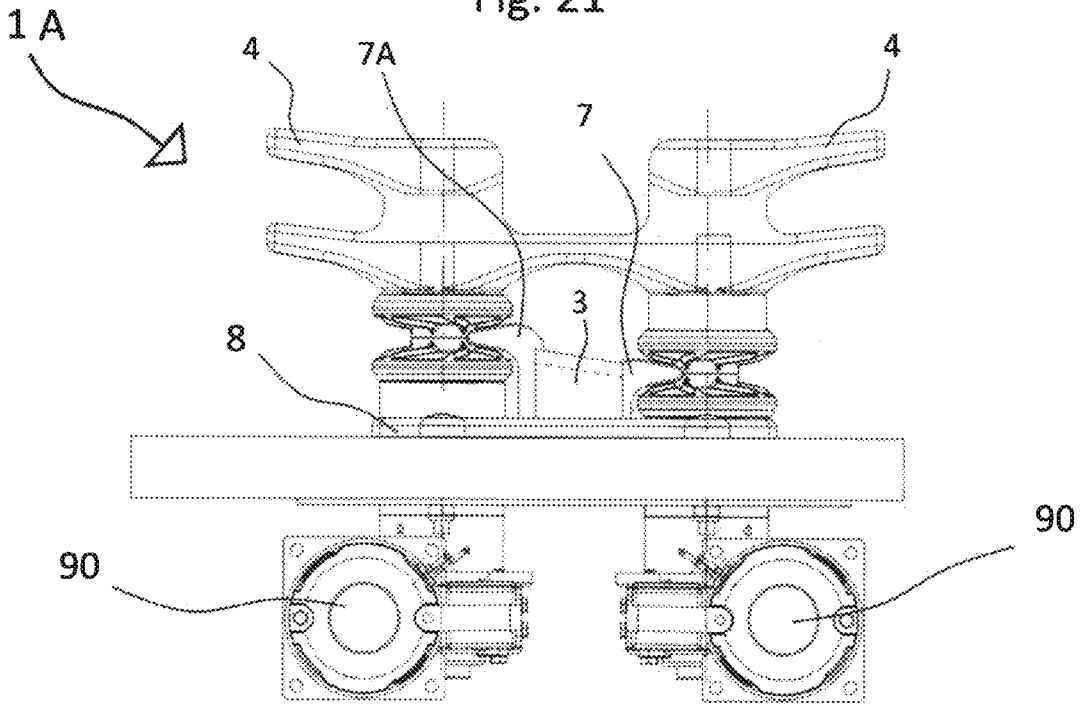
FIG. 22 is a side view of a nautical cleat according to an eighth embodiment of the present disclosure.

Furthermore, in these cases the cleat 1A may be provided with a connector 3 designed for guiding the rope 600 moving between the first towing element 5 and the second towing element 6. More particularly, said connector 3 connects the diverter element 7 to the further diverter element 7A, as shown in the embodiments of FIGS. 21 and 22.

Moreover, in all the cases, the transverse body 25 may comprise two additives protrusions 4 designed for allowing tying the rope 600 at a higher level. In other words, the additive protrusions 4 are two further tying elements which may be used for example with quays located at a higher level. This embodiment is shown in FIG. 22.

The present disclosure relates also to a boat comprising a deck 300 whereon a cleat 1, 1A, may be installed. In particular, through deck 300 a pass-through opening 400, passing through the entire thickness of deck 300, is defined. The first shaft 11 of cleat 1, 1A is installed at said opening 400 which is advantageously used to connect the actuating device 50, lying beneath deck 300, with the portion of the cleat 1, 1A arising above deck 300.

It is clear from the above description that the cleat 1, 1A fully achieve the intended aims and solved the above-highlighted problems of the existing devices. In particular, cleat 1, 1A is easy to be installed on a boat deck 300 and ease mooring operations, also in case of big and heavy vessels, by highly limiting the effort required from the sailor. Furthermore, the cleat 1, 1A as disclosed herein overtakes the breaking off problem, by adapting itself to the curvature of the deck 300. Moreover, providing positioning the actuating device 50 underneath the deck 300, the nautical cleat 1, 1A as disclosed herein does not encumber above the deck 300.

Several variations can be made to the above describe cleat 1, 1A all falling within the scope of the attached claims.

Thus, although there have been described particular embodiments of a new and useful invention, it is not intended that such references be construed as limitations upon the scope thereof except as set forth in the following claims.

What is claimed is:

1. A nautical cleat for tying a rope of a boat, said nautical cleat being installable on a deck comprising an upper surface and a lower surface, wherein said nautical cleat comprises:

a first shaft installable on said deck by means of a first positioning element, said first shaft supporting a first tying element (21);

a second shaft installable on said deck by means of a second positioning element, said second shaft supporting a second tying element;

a transverse body mechanically connecting said first tying element to said second tying element (22);

fastening means to securely fasten said first positioning element and said second positioning element to said deck;

a first roller-shaped towing element to tow and roll up said rope, wherein said towing element is rotatable about a first rotation axis defined by said first shaft;

a second roller-shaped towing element rotatable about a second rotation axis defined by said second shaft, said second rotation axis being substantially parallel to said first rotation axis;

an actuating device comprising at least one motor operatively connected to said first roller-shaped towing element and/or to said second roller-shaped towing element;

connecting means designed for directly or indirectly connecting the actuating device to said deck, so that said actuating device is placed in a position underlying said lower surface; and a spherical joint, operatively interposed between the first shaft and the transverse body, designed to allow the rotation of the transverse body with respect to said first shaft, around at least one substantially horizontal axis.

2. The nautical cleat of claim 1, wherein said towing element has a concave roller configuration defined by a first part and by a second part substantially symmetrical with respect to a plane substantially orthogonal to said first axis, each of said parts comprising a gripping surface tapered in the direction of said first axis so as to define, when the two parts are joined together, a concave portion of said towing element.

3. The nautical cleat of claim 1, wherein said spherical joint comprises an outer joint portion, designed to be fixed to the transverse element, and an inner joint portion, placed inside the outer joint portion and designed to be fixed to the first shaft.

4. The nautical cleat of claim 1, wherein said first shaft is rotatable about said first rotation axis together with said first towing element, said first shaft being operatively connected to said motor by means of a mechanical transmission.

5. The nautical cleat of claim 1, wherein the first rotation axis of said first towing element is substantially orthogonal to the rotation axis of said motor or wherein the first rotation axis of said first towing element is substantially parallel to the rotation axis of said motor.

6. The nautical cleat of claim 1, further comprising a diverter element designed for preventing rope from entirely rolling up around said first towing element.

7. The nautical cleat of claim 6, wherein said diverter element comprises an arm at least partially protruding into said concave portion of the first towing element or wherein said diverter element comprises a concave portion designed to house the rope.

8. The nautical cleat of claim 6, wherein said diverter element is fixed to said flange portion of said first positioning element or to deck or wherein said diverter element is fixed to said transverse element.

9. The nautical cleat of claim 2, wherein said first part and said second part of the first towing element are placed at a variable distance one from the other, in order to house ropes with different diameters therethrough.

10. The nautical cleat of claim 9, further comprising a spring located upwardly or downwardly said first towing element in order to allow reciprocal approaching and departing of said first part and second part from each other.

11. The nautical cleat of claim 1, wherein said first towing element and said second towing element are vertically offset in order to avoid the rope portion outgoing from the cleat from obstructing the rope portion entering therein.

12. The nautical cleat of claim 1, wherein said first shaft is rotatable about said first rotation axis together with said first towing element and said second shaft is rotatable about said second rotation axis together with said second towing element, said first shaft and said second shaft being operatively connected to said motor by means of a mechanical transmission.

13. The nautical cleat of claim 1, wherein the transverse body comprises two additives protrusions designed for allowing tying the rope at a higher level.

14. A nautical cleat for tying a rope of a boat, said nautical cleat being installable on a deck comprising an upper surface and a lower surface, wherein said nautical cleat comprises:

a first shaft installable on said deck by means of a first positioning element, said first shaft supporting a first tying element;

a second shaft installable on said deck by means of a second positioning element, said second shaft supporting a second tying element;

a transverse body mechanically connecting said first tying element to said second tying element;

fastening means to securely fasten said first positioning element and said second positioning element to said deck;

a first roller-shaped towing element to tow and roll up said rope, wherein said towing element is rotatable about a first rotation axis defined by said first shaft;

a second roller-shaped towing element rotatable about a second rotation axis defined by said second shaft, said second rotation axis being substantially parallel to said first rotation axis;

an actuating device comprising two motors a first one operatively connected to said first roller-shaped towing element and a second one operatively connected to said second roller-shaped towing element;

connecting means designed for directly or indirectly connecting the actuating device to said deck, so that said actuating device is placed in a position underlying said lower surface;

a spherical joint, operatively interposed between the first shaft and the transverse body, designed to allow the rotation of the transverse body with respect to said first shaft, around at least one substantially horizontal axis.

15. The nautical cleat of claim 14, wherein said two motors are actuated by a single actuation button.

16. The nautical cleat of claim 14, wherein said first towing element and said second towing element are vertically offset in order to avoid the rope portion outgoing from the cleat from obstructing the rope portion entering therein.

17. The nautical cleat of claim 14, wherein at least one of said towing elements has a concave roller configuration defined by a first part and by a second part substantially symmetrical with respect to a plane substantially orthogonal to said first axis, each of said parts comprising a gripping surface tapered in the direction of said first axis so as to define, when the two parts are joined together, a concave portion of said at least one of said towing elements.

18. The nautical cleat of claim 14, wherein said spherical joint comprises an outer joint portion, designed to be fixed to the transverse element, and an inner joint portion, placed inside the outer joint portion (and designed to be fixed to the first shaft.

19. The nautical cleat of claim 14, wherein the first rotation axis of said first towing element and the second rotation axis of the second towing element are substantially orthogonal to the rotation axis of said motor or wherein the first rotation axis of said first towing element and the second rotation axis of the second towing element are substantially parallel to the rotation axis of said motor.

20. The nautical cleat of claim 14, further comprising a diverter element designed for preventing rope from entirely rolling up around said first towing element and/or a further diverter element designed for preventing rope from entirely rolling up around the second towing element.

21. The nautical cleat of claim 20, wherein said diverter element and/or said further diverter element comprises an arm at least partially protruding into said concave portion of the first towing element or wherein said diverter element and/or said further diverter element comprise a concave portion designed to house the rope.

22. The nautical cleat of claim 20, wherein said diverter element is fixed to said flange portion of said first positioning element or to deck and/or said further diverter element is fixed on said second positioning element or to deck or wherein said diverter element and/or said further diverter element is fixed to said transverse element.

23. The nautical cleat of claim 22, comprising a connector designed for guiding the rope moving between the first towing element and the second towing element.

24. The nautical cleat of claim 17, wherein said first part and said second part of said at least one of said towing elements are placed at a variable distance one from the other, in order to house ropes with different diameters therethrough.

25. The nautical cleat of claim 24, further comprising a spring located upwardly or downwardly said at least one of said towing elements in order to allow reciprocal approaching and departing of said first parts and second parts from each other.

* * * * *